United States Patent [19]

Shimono

[11] 4,350,031

[45] * Sep. 21, 1982

[54] PUSHBUTTON OPERATED DOOR LOCKS

[76] Inventor: Junichi Shimono, 913 Enjoji, Kasamatsu-cho, Hashima-gun, Gifu-ken, Japan

[ * ] Notice: The portion of the term of this patent subsequent to Jan. 31, 1995, has been disclaimed.

[21] Appl. No.: 813,224

[22] Filed: Jul. 5, 1977

Related U.S. Application Data

[63] Continuation-in-part of Ser. No. 750,563, Dec. 14, 1976, Pat. No. 4,070,881.

[51] Int. Cl.[3] ..... E05B 37/02; E05B 37/16

[52] U.S. Cl. ..... 70/315

[58] Field of Search ..... 70/313, 314, 315, 316, 70/317, 318, 323, 327

[56] References Cited

U.S. PATENT DOCUMENTS

| | | | |
|---|---|---|---|
| 200,070 | 2/1878 | Loch | 70/317 |
| 745,081 | 11/1903 | Smith | 70/314 X |
| 1,144,887 | 6/1915 | Besharov | 70/316 X |
| 1,156,741 | 10/1915 | Besharov | 70/317 |
| 2,856,765 | 10/1958 | Sreb | 70/323 X |
| 3,379,040 | 4/1968 | Shimono | 70/313 |

*Primary Examiner*—Thomas J. Holko

*Attorney, Agent, or Firm*—Basile, Weintraub & Hanlon

[57] ABSTRACT

This invention relates to a pushbutton operated door lock particularly featured in that a number inputted for the unlocking operation can be very easily selected and changed on the inside of the door. The door lock includes a multiplicity of tumbler rings rotatably supported on a lock shaft with a lock bolt in a casing. The lock bolt has a multiplicity of notches engaging with the respective tumbler rings and is slidably supported along the lock shaft. Each tumbler ring is formed in its peripheral portion with a plurality of lateral bores in each of which an engage pin for restricting the angle of rotation is received for movement into and out of the lateral bore. Pushbuttons engageable with the respective tumbler rings to rotate them individually are associated with pushbuttons for rotating all the tumbler rings together, so that a selected number of tumbler rings are engaged with, or disengaged from the notches on the lock bolt upon rotation of the tumbler rings. The rear face of the casing on the inside of the door is formed with apertures for insertion of guide rods to move the engage pins inwardly or outwardly relative to the tumbler rings, whereby the angle of rotation of the tumbler rings within the casing can be easily restricted from the outside of the casing to permit free and very easy selection and change of the function of the pushbuttons, namely, the number for the unlocking operation from the inside of the door.

6 Claims, 69 Drawing Figures

PUSHBUTTON OPERATED DOOR LOCKS

This is a continuation-in-part of copending application Ser. No. 750,563 filed on Dec. 14, 1976, now U.S. Pat. No. 4,070,881.

This invention relates to a pushbutton operated door lock.

The inventor of this invention has previously developed a pushbutton operated door lock which can be opened and closed with a high degree of surety and reliability by simple pushbutton operation either on the inside or outside of a door on which the lock is mounted. There are also known other mechanical pushbutton operated door locks that can be opened or closed by simple pushbutton operation, whether indoors or outdoors. These known mechanical door locks are, however, unsatisfactory because after they are assembled, it is difficult to easily change the number indicating the pushbuttons to be depressed for opening the lock. Some excellent electrical pushbutton operated door locks are known, but they are unsatisfactory because of their entire uselessness during power or battery failure. Thus, mechanical door locks are by far more suitable, but any known mechanical pushbutton operated door lock that can be opened or closed by simple pushbutton operation, whether on the inside or outside of the door presents difficulty in number changing, while any known mechanical pushbutton operated door lock that permits number changing by means of a small tool can be used for the locking or unlocking operation only on the outdoor side of the door, and never on the indoor side. It is generally considered to be ideal to provide a mechanical pushbutton operated door lock which can not merely be opened or closed by simple pushbutton operation either on the inside or outside of a door on which it is mounted, but also permits free and easy number selection and changing, so that the door lock is very effective for crime prevention. But no such mechanical pushbutton operated door lock is known and it has heretofore been considered very difficult to provide any such door lock.

It is an object of this invention to provide an ideally improved mechanical pushbutton operated door lock of the novel, unique and improved construction which satisfies all of the afore-mentioned requirements.

The invention will now be described in detail by way of example with reference to the accompanying drawings, in which.

Figure 37:
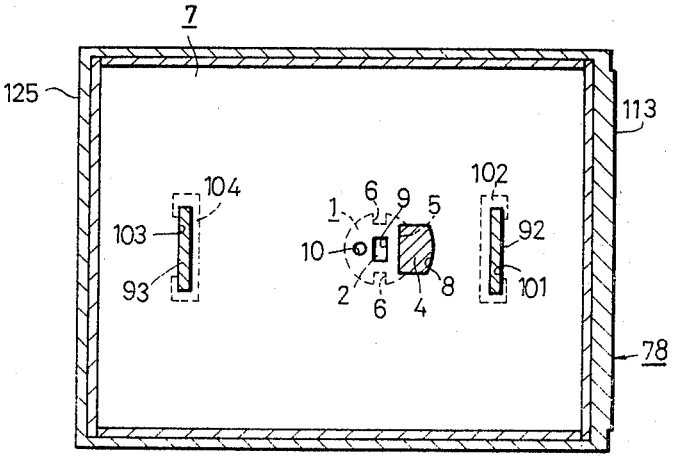
FIG. 37 is a vertical sectional view taken along the line XXXVII—XXXVII of FIG. 6.
Figure 39:
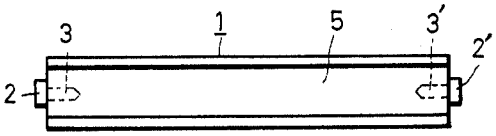
FIG. 39 is a front elevational view of the lock shaft.
Figure 40:
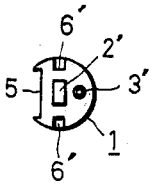
FIG. 40 is a side elevational view of the lock shaft.
Figure 41:
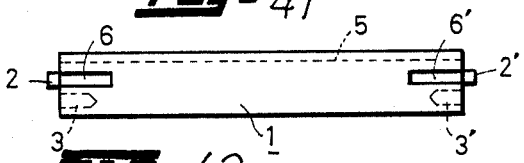
FIG. 41 is a bottom plan view of the lock shaft.
Figure 42:
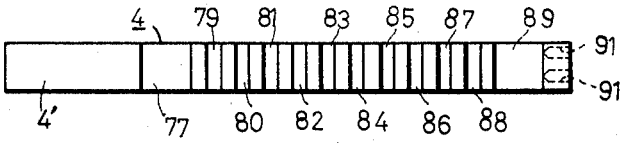
FIG. 42 is a front elevational view of the lock bolt.
Figure 43:
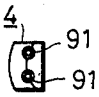
FIG. 43 is a side elevational view of the lock bolt.
Figure 44:
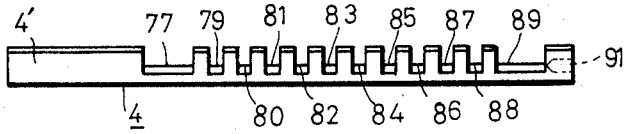
FIG. 44 is a bottom plan view of the lock bolt.

Referring now to the drawings more particularly, reference numeral 1 indicates a generally solid cylindrical lock shaft formed at its opposite ends with a pair of longitudinally extending projections 2 and 2' and a pair of tapped holes 3 and 3' as shown in FIGS. 39 through 41. The lock shaft 1 is provided on its peripheral surface with a guide groove 5 extending along its entire length and adapted to receive a lock bolt 4. The peripheral surface of the lock shaft 1 is further provided with two pairs of diametrically opposite slots 6 and 6', one of which pairs is located at each end of the lock shaft 1. Numeral 7 indicates a vertically disposed rectangular base plate formed therethrough with a guide opening 8 located somewhat to the right of the center of the horizontal centerline of the base plate 7 as shown in FIG. 37 and adapted for receiving the lock bolt 4 slidably. The base plate 7 is further provided with two apertures 9 and 10 in the vicinity of the guide opening 8 which are located on the horizontal centerline of the base plate 7. The apertures 9 and 10 are alignable with the projection 2 and the tapped hole 3, respectively, of the lock shaft 1.

Figure 38:
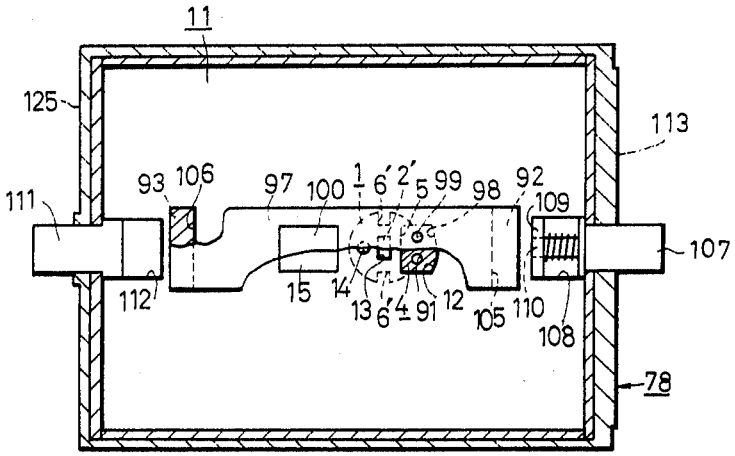
FIG. 38 is a vertical sectional view taken along the line XXXVIII—XXXVIII of FIG. 6.

Another base plate 11 is of the identical shape and size to the base plate 7 and adapted for location opposite thereto. The base plate 11 is likewise provided therethrough with a guide opening 12 adapted for receiving the lock bolt 4 slidably and two apertures 13 and 14 alignable with the projection 2' and the tapped hole 3', respectively, of the lock shaft 1 as shown in FIG. 38. The guide opening 12 is alignable with the guide opening 8 of the base plate 7 and the apertures 13 and 14 are alignable with the apertures 9 and 10, respectively, of the base plate 7. Thus, the lock shaft 1 is fixedly supported between the two base plates 7 and 11. A piece of iron 15 is secured to the base plate 11 somewhat to the left of the aperture 14 as viewed in FIG. 38 for the purpose of magnetic attraction as will hereinafter be described in further detail.

Figure 56:
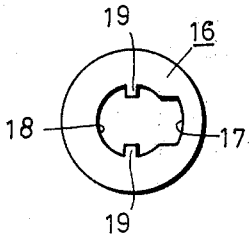
FIGS. 56 to 58 are side elevational views of three washers, respectively.

As shown in FIG. 56, a circular washer 16 is provided centrally with a circular hole 18 for receiving the lock shaft 1. The hole 18 is radially enlarged along a portion of its circumference to define a lock bolt guiding recess 17 which is alignable with the guide opening 8 in the base plate 7. The washer 16 is further formed with a pair of diametrically oppositely disposed engaging projections 19 radially inwardly projecting from the edge of the hole 18. The projections 19 are engageable with the slots 6 on the lock shaft 1.

Figure 57:
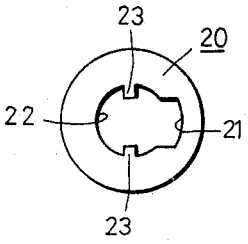

FIG. 57 shows a circular washer 20 which is of the identical shape and size to the washer 16 of FIG. 56 except in thickness. The door lock of this invention employs a couple of such washers 20. Each washer 20 is likewise provided with a central hole 22, a lock bolt guiding recess 21 and a pair of radially inwardly extending engaging projections 23.

Figure 58:
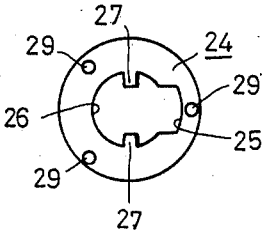
Figure 59:
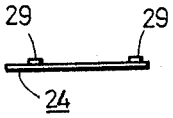
FIG. 59 is a bottom plan view of the washer shown in FIG. 58.
Figure 60:
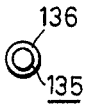
FIG. 60 is a front elevational view of one of a pair of guide rods.
Figure 61:
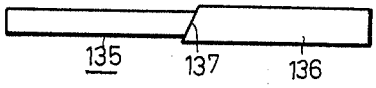
FIG. 61 is a side elevational view of the guide rod shown in FIG. 60.
Figure 62:
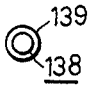
FIG. 62 is a front elevational view of the other guide rod.
Figure 63:
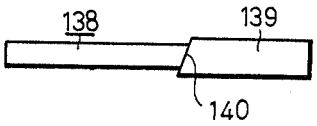
FIG. 63 is a side elevational view of the guide rod shown in FIG. 62.

The door lock of this invention includes a further circular washer 24 which is of the identical shape and size to the washer 20 of FIG. 57 and which is likewise provided with a central lock shaft receiving hole 26, a lock bolt guiding recess 25 and a pair of radially inwardly extending engaging projections 27 as shown in FIG. 58. The washer 24 is formed on one face thereof with three spacer projections 29 which are generally equally spaced from one another as shown in FIG. 58. As will hereinafter be described in further detail, the washer 24 is positioned adjacent to a tumbler ring 28 and the spacer projections 29 serve to maintain the tumbler ring 28 in adequately spaced relationship from the planar face of the washer 24 to minimize frictional resistance of the washer 24 to the tumbler ring 28 during rotation of the latter.

Figure 46:
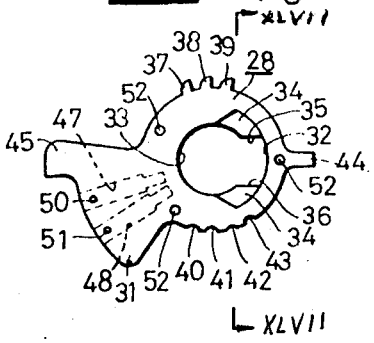
FIG. 46 is a side elevational view of the tumbler ring.
Figure 47:
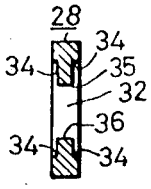
FIG. 47 is a vertical sectional view taken along the line XLVII—XLVII of FIG. 46.

The door lock of this invention includes five tumbler rings 28, each of which has a circular planar body of the identical size to the washer 24 and includes a lateral extension 31 radially outwardly projecting from a portion of the outer circumference of the circular body as shown in FIG. 46. The lateral extension 31 is provided with a pair of elongate bores 47 and 48 extending radially relative to the circular body and each adapted to receive an engage pin 30 as will hereinafter be described in further detail. The circular body of the tumbler ring 28 has a circular lock shaft receiving hole 33 in its center. The hole 33 is radially outwardly enlarged along a part of its edge to define a lock bolt guiding recess 32 which is alignable with the guide opening 8 of the base plate 7. The tumbler ring 28 includes a pair of reduced thickness portions 34 on both sides thereof as best shown in FIG. 47, whereby a pair of arcuately shaped tongues 35 and 36 are defined around the hole 33 with the lock bolt guiding recess 32 in between. Each of the tongues 35 and 36 has an inner arcuate edge terminating at the edge of the hole 33 and an outer arcuate edge circumscribing the outer limit of the lock bolt guiding recess 32 as best shown in FIG. 46. The tongues 35 and 36 have an equal arcuate length which is slightly greater than the angular distance by which the lock bolt guiding recess 32 is displaced upon rotation of the tumbler ring 28 in either direction about its own axis over a distance twice as large as a predetermined angle. The tongues 35 and 36 are engageable with notches formed on the lock bolt 4 as will hereinafter be described in further detail. The tumbler ring 28 is formed along its upper outer circumferential portion with ratchet teeth 37, 38 and 39. The ratchet tooth 38 lies on the central vertical line of the tumbler ring 28 and the other ratchet teeth 37 and 39 are spaced in opposite directions from the ratchet tooth 38 by a predetermined angular distance. The tumbler ring 28 is further formed with semicircular recesses 40, 41, 42 and 43 along its lower outer circumferential portion. The recess 41 lies on the central vertical line of the tumbler ring 28. The recess 40 is spaced a predetermined angular distance to the left of the recess 41 and the recess 42 is spaced to the right of the recess 41 by a predetermined angular distance, while the recess 43 is spaced the same distance to the right of the recess 42, as illustrated in FIG. 46. The portion of the tumbler ring 28 on which the recesses 40, 41, 42 and 43 are formed is diametrically opposite to that portion from which the ratchet teeth 37, 38 and 39 project. The recess 41 lies on the centerline on which the central ratchet tooth 38 is positioned. The tumbler ring 28 is provided with a radially outwardly projecting finger 44 lying on an extension of the radial centerline of the lock bolt guiding recess 32 as shown at right in FIG. 46. Another finger 45, which is wider than the finger 44 and diametrically opposite thereto, radially outwardly projects from the circular body as shown at left in FIG. 46. The finger 45 is integral with, and projects beyond, the outer extremity of the extension 31. The bores 47 and 48 are circumferentially spaced from the finger 45 toward the recess 40 and each receive at its bottom a spring 46 which urges the engage pin 30 radially outwardly relative to the tumbler ring 28.

Figure 45:
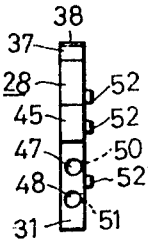
FIG. 45 is a rear elevational view of a tumbler ring.

The extension 31 of the tumbler ring 28 is further provided with a pair of angularly spaced-apart apertures 50 and 51 formed somewhat inwardly of the outer extremity of the extension 31 and each connected at right angles with one of the lateral bores 47 and 48 as is apparent from FIGS. 45 and 46. The apertures 50 and 51 each receive a stop pin 49 adapted to restrict the movement of the engage pin 30 as will hereinafter be described in further detail. The tumbler ring 28 further includes three spacer projections 52 formed on one surface of its circular body and located somewhat inwardly of the outer circumference of the circular body as shown in FIG. 46. The spacer projections 52 are generally equally spaced apart from one another and provide means for maintaining an adequate spacing between the tumbler ring 28 and another tumbler ring 28' which is placed in alternating relation to the tumbler ring 28 as will hereinafter be described in further detail, and for minimizing frictional contact between the tumbler rings 28 and 28' during their individual rotation relative to each other.

Figure 64:
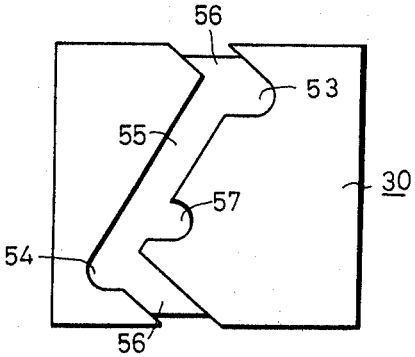
FIG. 64 is an exploded view of an engage pin.
Figure 65:
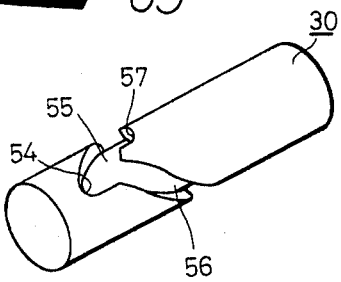
FIG. 65 is a perspective view of the engage pin shown in FIG. 64.
Figure 66:
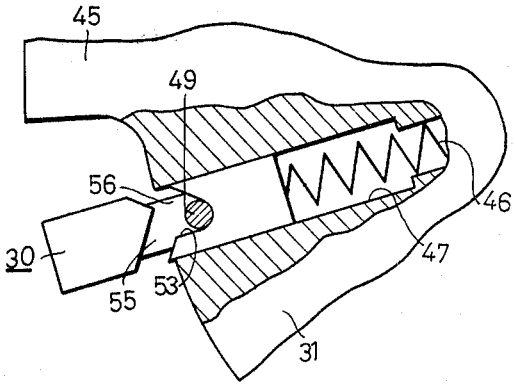
FIG. 66 is a side elevational view of one engage pin shown with a fragmentary illustration of the associated tumbler ring.

Referring to FIG. 65, the engage pin 30 is of the solid cylindrical construction. The door lock of this invention employs twenty engage pins 30 of the identical construction. The engage pin 30 is formed on its circumferential surface with a first recess 53 in its mid-portion slightly toward one end (right hand) of the engage pin 30 as shown in FIGS. 64 and 66. The engage pin 30 is also provided with a second recess 54 which is circumferentially spaced apart from the first recess 53 by an angular distance equal to about two-thirds of the circumference of the engage pin 30. The second recess 54 is offset toward the other end (left hand) of the engage pin 30 as shown in FIGS. 64 and 65. The first and second recesses 53 and 54 are connected with each other by an oblique guide groove 55 which receives a stop pin 49 for its free movement relative to the guide groove 55. The first and second recesses 53 and 54 are further connected with each other by a steeply inclined second guide groove 56 on the opposite side of the engage pin 30 from the first guide groove 55. The engage pin 30 is further formed with a third recess 57 located on the right-hand side of the first guide groove 55 as viewed in FIG. 64 and opening into the first guide groove 55. The third recess 57 is positioned in the vicinity of the second recess 54 and releasably receives the stop pin 49 as will hereinafter be described in further detail.

Figure 69:
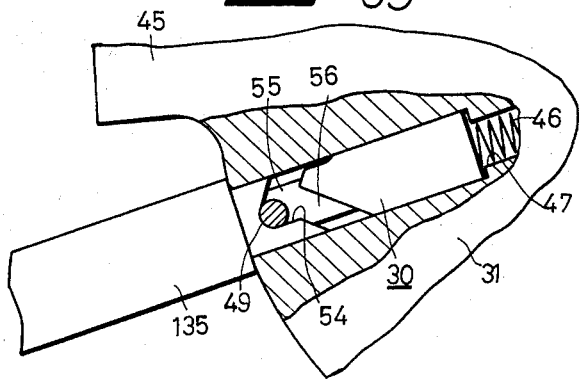
FIG. 69 is a view similar to FIG. 68, but showing the engage pin in a different position relative to the tumbler ring.

When an engage pin 30 is inserted into each of the lateral bores 47 and 48 of each tumbler ring 28 or 28', the inner end of the engage pin 30 rests against a spring 46 within the lateral bore and the engage pin 30 is held to the tumbler ring by a stop pin 49 extending through the aperture 50 or 51 into the first recess 53, so that the engage pin 30 is concealed in the lateral bore 47 or 48 along about a half of its length, while the remaining half of the engage pin 30 exposes itself beyond the outer limit of the tumbler ring as illustrated in FIG. 66. In its position shown in FIG. 66, each engage pin 30 have its outer extremity circumscribing the outer extremity of the finger 45, so that each engage pin 30 can functionally take the place of the finger 45, whenever appropriate. Application to the engage pin 30 of an external force directed toward the center of the tumbler ring 28 results in rotation and inward axial displacement of the engage pin 30 against the action of the spring 46 as it is guided by the stop pin 49 which moves relative to the engage pin 30 in such a manner that it leaves the first recess 53 and slides along the first guide groove 55, whereby the engage pin 30 is eventually totally concealed in the lateral bore 47 upon receipt of the stop pin 49 in the second recess 54 as shown in FIG. 69. The first and second recesses 53 and 54 and the first and second guide grooves 55 and 56 are so related in shape and position to one another that upon interruption of such external force application, the normal action of the spring 46 causes the stop pin 49 to displace itself relative to the engage pin 30 in such a manner that the stop pin 49 leaves the second recess 54 and moves back into the first recess 53 through the second guide groove 56 to expose about a half of the length of the engage pin 30 out of the extension 31 as shown in FIG. 66.

Figure 67:
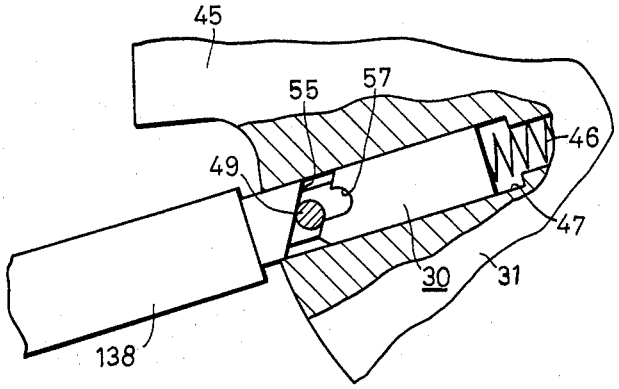
FIG. 67 is a view similar to FIG. 66, but showing the engage pin in a different position relative to the tumbler ring.
Figure 68:
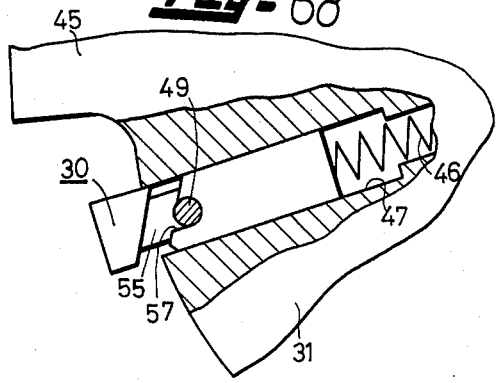
FIG. 68 is a view similar to FIG. 67, but showing the engage pin in a different position relative to the tumbler ring.

If such force application to the engage pin 30 is interrupted somewhat earlier, namely, prior to complete withdrawal of the engage pin 30 into the lateral bore 47 when the stop pin 49 stays substantially on a horizontal centerline of the third recess 57, but slightly in the direction of the second recess 54 as illustrated in FIG. 67, the spring 46 urges the engage pin 30 outwardly and the engage pin 30 rotates in a reverse direction to allow the stop pin 49 to move back relative to the engage pin 30 along the first guide groove 55 and slip into the third recess 57, whereby the engage pin 30 is held in position as shown in FIG. 68. In its position shown in FIG. 68, the engage pin 30 is concealed in the lateral bore 47 along the major part of its length and only a minor lengthwise portion of the engage pin 30 remains outside of the extension 31. Further application of an external force to the engage pin 30 in the direction of the center of the tumbler ring 28, when necessary, causes displacement of the stop pin 49 from the third recess 57 into the second recess 54, whereupon the engage pin 30 is totally withdrawn into the lateral bore 47 as shown in FIG. 69. Interruption of the force application at this moment results in rotation of the engage pin 30 along the second guide groove 56 under the action of the spring 46 with relative displacement of the stop pin 49 from the second recess 54 to the first recess 53, whereupon about a half lengthwise portion of the engage pin 30, which is equal in length to the finger 45, is exposed outside the lateral bore 47 with the remaining half staying in the lateral bore 47 and functionally takes the place of the finger 45.

The tumbler ring 28' is of the identical shape and size to the tumbler ring 28 except that the positions of the ratchet teeth 37, 38 and 39, the recesses 40, 41, 42 and 43 and the lateral extension 31 in the tumbler ring 28 are inverted in the tumbler ring 28'. The door lock of this invention is provided with five such tumbler rings 28'. Like the tumbler ring 28, each tumbler ring 28' has in its center a lock shaft receiving hole 33' formed with an engaging recess 32' aligned with the guide opening 8 to guidingly receive the lock bolt 4. The tumbler ring 28' includes a pair of reduced thickness portions 34' on both sides thereof, whereby a pair of arcuately shaped tongues 35' and 36' are defined around the hole 33' with the lock bolt guiding recess 32' in between. The tongues 35' and 36' have an equal arcuate length which is slightly greater than the angular distance by which the recess 32' is displaced upon rotation of the tumbler ring 28' in either direction about its own axis over a distance twice as large as a predetermined angle. The tongues 35' and 36' are engageable with the notches on the lock bolt 4 as will hereinafter be described in further detail. The tumbler ring 28' includes a series of circumferentially spaced-apart ratchet teeth 37', 38' and 39' arranged along the lowermost portion of its outer periphery, the central ratchet tooth 38' lying on the vertical centerline of the tumbler ring 28' and the other two ratchet teeth 37' and 39' being spaced apart in opposite directions from the central ratchet tooth 38'. Likewise, a series of semi-circular recesses 40', 41', 42' and 43' are provided along the uppermost portion of the outer periphery of the tumbler ring 28' and equally spaced apart from one another. The recess 41' lies on the centerline on which the central ratchet tooth 38' is located, and the recess 40' is positioned on the opposite side of the recess 41' from the recesses 42' and 43'. The tumbler ring 28' includes an engaging projection or finger 44' projecting radially outwardly from the rightmost edge of the tumbler ring 28' and another engaging projection or finger 45' which is diametrically opposite to the finger 44' and which is integrally formed with a lateral extension 31' radially outwardly projecting from the tumbler ring 28' in the vicinity of the recess 40'. Parts indicated by numerals 34', 35', 36', 44', 47', 48', 50', 51' and 52' are substantially of the identical construction or configuration to their counterparts shown at 34, 35, 36, 44, 47, 48, 50, 51 and 52 on the tumbler ring 28. They are all functionally similar to their counterparts on the tumbler ring 28. No repeated description would be necessary to any person of ordinary skill in the art.

Figure 48:
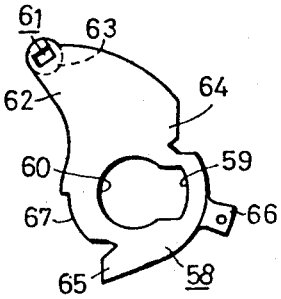
FIG. 48 is a side elevational view of one of a pair of locking rings.
Figure 49:
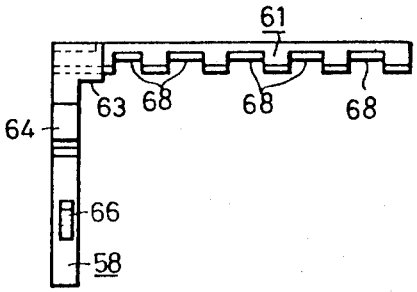
FIG. 49 is a front elevational view of the locking ring of FIG. 48 shown with a driving rod.

Numeral 58 indicates a driving ring for the locking purpose having in its center a lock shaft receiving hole 60 laterally formed with a radially outwardly extending recess 59 alignable with the guide opening 8. The driving ring 58 includes an enlarged lateral extension defining a driving lever 62 to which a driving rod 61 is secured. The driving rod 61 is so positioned that it is spaced apart from the finger 45' of the tumbler ring 28' by an angular distance equal to three times as large as a predetermined angle when the recess 59 and the central hole 60 of the driving ring 58 are aligned with the recess 32' and the central hole 33', respectively, of the tumbler ring 28'. Numeral 63 indicates an increased thickness portion projecting from the rear surface of the driving lever 62 to rigidly connect the driving rod 61 to the driving lever 62. The driving ring 58 is further formed with an abutment edge 64 extending substantially radially outwardly relative to the central hole 60 and so positioned relative to the driving ring 58 that the driving ring 58 may be rotated at an angle equal to three times as large as a predetermined angle when force is applied to the abutment edge 64 in a counterclockwise direction as viewed in FIG. 48. Another substantially radially outwardly projecting abutment edge 65 is formed generally diametrically opposite to the abutment edge 64 and so positioned relative to the driving ring 58 that the driving ring 58 may be rotated at an angle equal to three times as large as a predetermined angle when force is applied to the abutment edge 65 in a counterclockwise direction as viewed in FIG. 48. A radially outwardly projecting lug 66 is provided in a position between the abutment edges 64 and 65 for retaining a spring as will hereinafter be described. The driving ring 58 is further formed with a circumferential recess 67 in a position generally diametrically opposite to the abutment edge 64. The recess 67 assists smooth rotation of the driving ring 58.

The driving rod 61 is formed with five equally spaced-apart notches 68. In the door lock assembly of this invention, the five tumbler rings 28 and the five tumbler rings 28' are placed in alternating relationship to each other as will hereinafter be described. Each of the tumbler rings 28 is aligned with one of the notches 68, while each tumbler ring 28' is aligned with one of the unnotched portions or teeth on the driving rod 61. Each unnotched portion of the driving rod 61 engages the finger 45' on one of the tumbler rings 28' to thereby rotate the tumbler ring 28'. The notches 68 prevent interference of the driving rod 61 with the operation of the fingers 45 on the tumbler rings 28.

Figure 50:
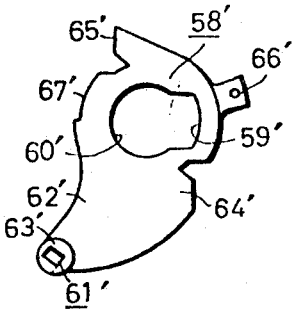
FIG. 50 is a side elevational view of the other locking ring.
Figure 51:
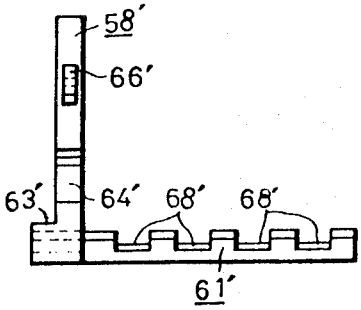
FIG. 51 is a front elevational view of the locking ring of FIG. 50 shown with another driving rod.
Figure 52:
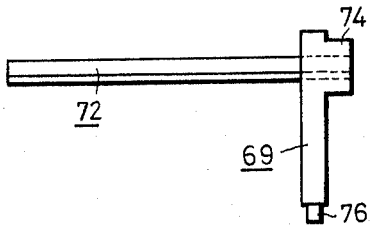
FIG. 52 is a front elevational view of one of a pair of unlocking rings shown with a driving rod.

Numeral 58' indicates another driving ring for the locking purpose which is shaped in the inverted form of the first mentioned driving ring 58. Compare FIGS. 48 and 50, and look particularly at the counterparts of the driving lever 62, the increased thickness portion 63, the abutment edges 64 and 65 and the lug 66 which are shown at 62', 63', 64', 65' and 66', respectively, in FIG. 50. The driving ring 58' is otherwise identical in construction to the driving ring 58. The driving ring 58' has a lock shaft receiving hole 60' formed with an engaging recess 59' alignable with the guide opening 8. The driving lever 62' extends radially outwardly from the the peripheral edge of the hole 60' in a symmetrically opposite relation to the driving lever 62 of the driving ring 58. A driving rod 61' is secured to the increased thickness portion 63' on the front face of the driving lever 62' and is so positioned relative to the finger 45 on the tumbler ring 28 that when the recess 59' and the hole 60' of the driving ring 58' are aligned with the recess 32 and the hole 33, respectively, of the tumbler ring 28, the driving rod 61' is spaced apart from the finger 45 an angular distance equal to three times as large as a predetermined angle. The first abutment edge 64' is so positioned as to permit rotation of the driving ring 58' by an angular distance equal to three times as large as a predetermined angle upon clockwise application of force to the abutment edge 64'. Likewise, the second abutment edge 65' is positioned to permit rotation of the driving ring 58' by an angular distance equal to three times as large as a predetermined angle upon clockwise application of force to the abutment edge 65'. A lug 66' is provided for retaining a spring. The driving ring 58' is peripherally recessed at 67' for its smooth rotation.

Figure 3:
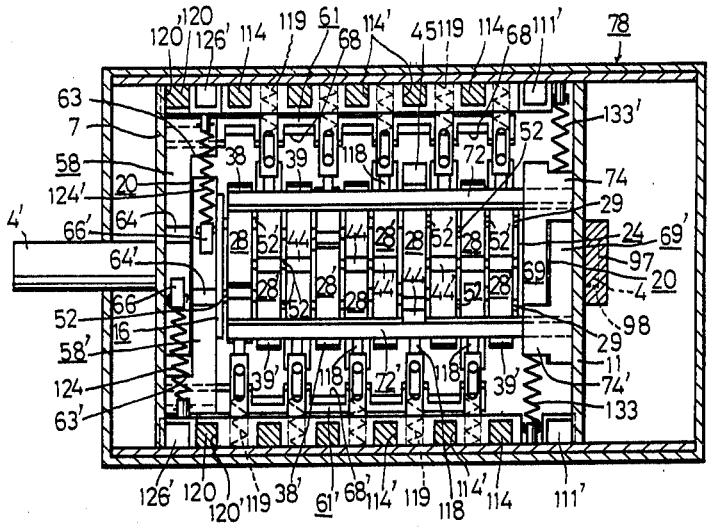
FIG. 3 is a view of a vertical section through the lock casing showing the various parts therein in front elevation.
Figure 4:
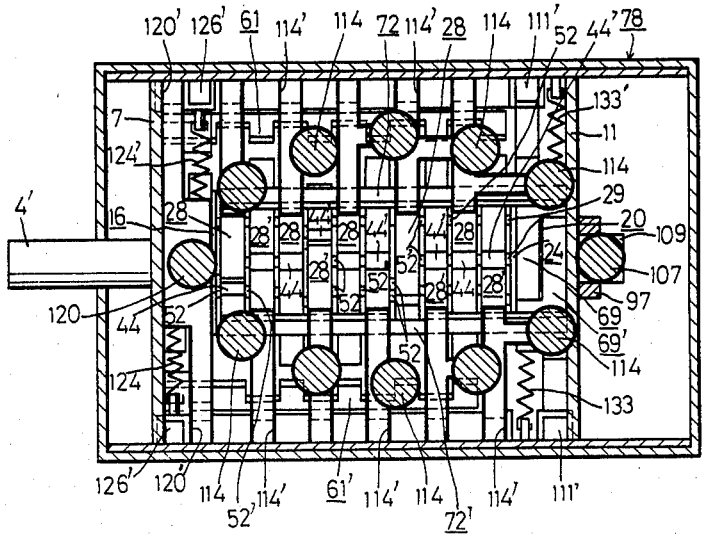
FIG. 4 is a view similar to FIG. 3, but showing a different vertical section.
Figure 5:
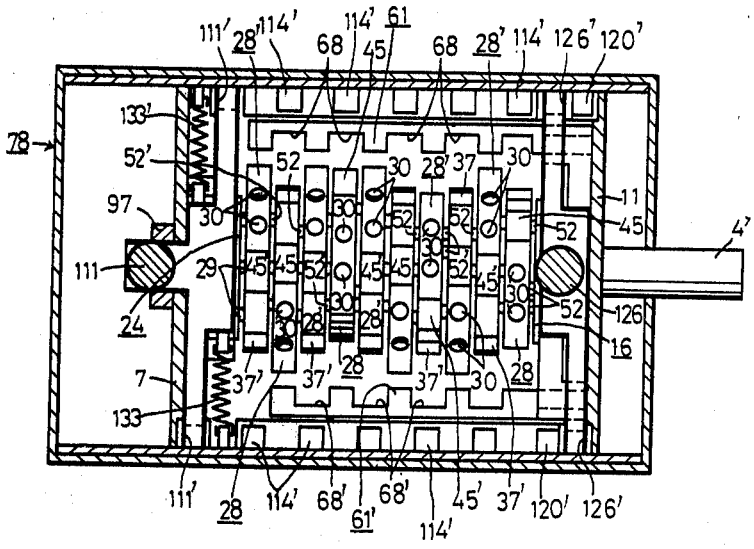
FIG. 5 is a view of a vertical section through the lock casing showing the various parts therein in rear elevation.

The driving rod 61' is formed with four longitudinally spaced-apart notches 68'. As shown in FIG. 3, each notch 68' is aligned with one of four out of the five tumbler rings 28', while each unnotched portion or tooth of the driving rod 61' is aligned with one of the tumbler rings 28. The driving rod 61' thus engages the finger 45 on each tumbler ring 28 to cause rotation of the tumbler ring 28. Because of the provision of the notches 68', however, the driving rod 61' moves past the finger 45' on each tumbler ring 28' and does not interfere with the function of the fingers 45'.

Numeral 69 indicates a first driving ring for the unlocking purpose. Like the tumbler ring 28', the driving ring 69 has in its center a lock shaft receiving hole 71 formed with an engaging recess 70 which is alignable with the guide opening. A driving lever 73 extends radially outwardly from the peripheral edge of the hole 71 and has on its rear face an increased thickness portion 74 to which a driving rod 72 is rigidly connected. The driving rod 72 is so positioned relative to the driving ring 69 that the driving rod 72 is spaced apart from the finger 44' on the tumbler ring 28' by an angular distance equal to twice as large as a predetermined angle when the recess 70 and the hole 71 of the driving ring 69 are aligned with the recess 32' and the hole 33', respectively, of the tumbler ring 28'. An abutment edge 75 is formed on the peripheral edge of the driving ring 69 and so positioned relative to the driving ring 69 that application of force to the abutment edge 75 in a clockwise direction permits rotation of the driving ring 69 by an angular distance equal to twice as large as a predetermined angle. The driving ring 69 is further provided with a radially outwardly projecting lug 76 which is diametrically opposite to the increased thickness portion 74 and to which a spring is fastened.

The driving rod 72 is adapted to engage the finger 44 on the tumbler ring 28 or the finger 44' on the tumbler ring 28' to actuate the tumbler ring 28 or 28' as hereinafter described.

Figure 53:
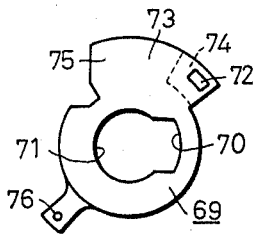
FIG. 53 is a side elevational view of the unlocking ring shown in FIG. 52.
Figure 54:
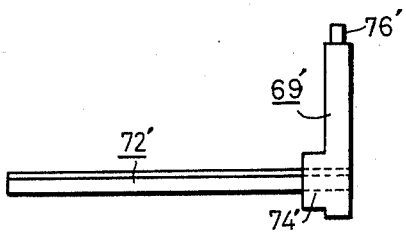
FIG. 54 is a front elevational view of the other unlocking ring shown with another driving rod.
Figure 55:
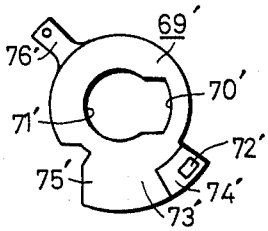
FIG. 55 is a side elevational view of the unlocking ring shown in FIG. 54.

A second driving ring 69' for the unlocking purpose is constructed in the symmetrically inverted shape of the first driving ring 69. Compare FIGS. 53 and 55 and particularly note the positions of a driving lever 73', an increased thickness portion 74' on the front face of the driving ring 69', a radially outwardly extending abutment edge 75' and a radially outwardly projecting lug 76' for retaining a spring. Like the tumbler ring 28, the driving ring 69' includes a central lock shaft receiving hole 71' formed with an engaging recess 70'. A driving rod 72' is rigidly connected to the increased thickness portion 74' and so positioned relative to the driving ring 69' that the driving rod 72' is spaced apart from the finger 44 on the tumbler ring 28 by an angular distance equal to twice as large as a predetermined angle when the recess 70' and the hole 71' of the driving ring 69' are aligned with the recess 32 and the hole 33, respectively, of the tumbler ring 28. The abutment edge 75' is so positioned as to permit rotation of the driving ring 69' by an angular distance equal to twice as large as a predetermined angle upon application of force to the abutment edge 75' in a counterclockwise direction as viewed in FIG. 55. The driving rod 72' is adapted to engage the finger 44 on the tumbler ring 28 or the finger 44' on the tumbler ring 28' to rotate the tumbler ring 28 or 28'.

The lock bolt 4 is provided at one end with an outward extension 4' for the locking purpose. The lock bolt 4 is formed with a notch 77 for lockingly engaging driving rings 58 when they are rotated. The notch 77 is spaced apart from one end of the lock bolt 4 by a distance equal to the length of the outward extension 4' plus the thickness of wall of the casing 78, the gap between the casing 78 and the base plate 7 and the thickness of the base plate 7. The notch 77 has a longitudinal width which is equal to the combined thickness of the first driving ring 58 for the locking purpose, the washer 20 and the second driving ring 58' for the locking purpose. The lock bolt 4 is further formed with a series of engaging notches 79 to 88, inclusive, which are equally spaced apart from one another longitudinally of the lock bolt 4 to alternately receive the upper tongue 35 of the lower tongue 36 on one tumbler ring 28 or the lower tongue 35' or the upper tongue 36' on an adjacent tumbler ring 28'. Each of the notches 79 through 88 has a width which is, as measured longitudinally of the lock bolt 4, substantially equal to the thickness of the tongue 35 on the tumbler ring 28. The first smaller notch 79 closest to the first major notch 77 is spaced away from the latter by a distance equal to the thickness of the washer 16 plus the length of the spacer projections 52 on the tumbler ring 28 and the depth of one of the reduced thickness portions 34 on the tumbler ring 28. The second smaller notch 80 is spaced apart from the first notch 79 by a distance equal to the depth of the other reduced thickness portion 34 on the tumbler ring 28 plus the length of the spacer projections 52' on an adjacent tumbler ring 28' and the depth of one of the reduced thickness portions 34' on the tumbler ring 28'. The remaining notches 81 to 88 are spaced apart from one another by the same distance that keeps the first and second notches 79 and 80 apart from each other. The second major notch 89 is spaced apart from the last smaller notch 88 by a distance equal to the depth of one of the reduced thickness portions 34' on an adjacent tumbler ring 28' plus the thickness of the washer 24. The notch 89 has a longitudinal width which is equal to the combined thickness of the first driving ring 69 for the unlocking purpose, the washer 20 and the second driving ring 69' for the unlocking purpose. The notch 89 is spaced inwardly of the other end of the lock bolt 4 sufficiently to provide allowance for supporting the base plate 11 and a propelling member 90. The other end of the lock bolt 4 is formed with a pair of tapped holes 91 for receiving screws to secure the propelling member 90.

The propelling member 90 is adapted for moving the lock bolt 4 forward and backward. The front and rear portions 92 and 93 of the propelling member 90 are identical in shape to each other. The front portion 92 is formed therethrough in its mid-portion with a plurality of tooth receiving apertures 96 adapted to receive a plurality of teeth 95 on the base portion of a lever 94 for moving the lock bolt 4 forward and backward. The rear portion 93 is likewise provided therethrough in its mid-portion with a plurality of tooth receiving apertures 96' adapted to receive a plurality of teeth 95' on the base portion of a lever 94' for moving the lock bolt 4 forward and backward. The side portion 97 of the propelling member 90 is formed with a hole 98 located closer to the front portion 92 than to the rear portion 93 and adapted for receiving the lock bolt 4 rigidly. The side portion 97 is further formed therethrough with a pair of apertures 99 connected with the hole 98 and alignable with the tapped holes 91 on the lock bolt 4 to secure the lock bolt 4. A magnet 100 is mounted on the side portion 97 in a position slightly closer to the rear portion 93 than to the front portion 92. The magnet 100 is disposed opposite to the iron piece 15 on the base plate 11.

Figure 6:
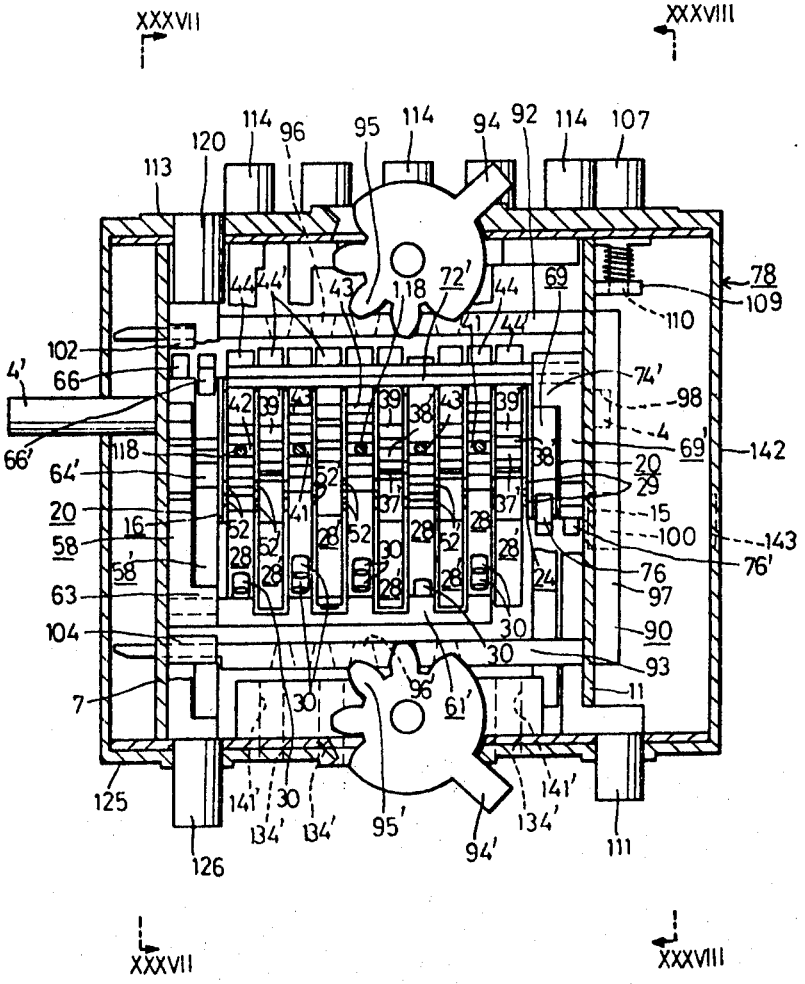
FIG. 6 is a view of a horizontal section through the lock casing showing the various parts in bottom plan.

If the lever 94 is rotated to the right as viewed in FIG. 6 with the teeth 95 engaged with the tooth receiving apertures 96 on the front portion 92 of the propelling member 90 and the teeth 95' of the lever 94' engaged with the tooth receiving apertures 96' on the rear portion 93 of the propelling member 90, the propelling member 90 is moved forward to the left as viewed in FIG. 6 to move the lock bolt 4 forward in the same direction until the magnet 100 on the side portion 97 contacts the iron piece 15 on the base plate 11. To the contrary, if the lever 94 is turned to the left as viewed in FIG. 6, the propelling member 90 is moved backward to the right as viewed in FIG. 6 and the lock bolt 5 is thereby retracted.

The base plate 7 is formed therethrough with a pair of parallel slots 101 and 103 which extend parallel to, and are equally spaced from the opposite vertical edges of the base plate 7, and which perpendicularly cross a horizontal centerline of the base plate 7 on which the aperture 10 has its center, as shown in FIG. 37. The front and rear portions 92 and 93 of the propelling member 90 slidably extend through the slots 101 and 103, respectively, as shown in FIGS. 6 and 37. A pair of parallel guide members 102 and 104 each having a guide groove extending longitudinally of the propelling member 90 extend from the interior surface of the base plate 7 as shown in FIGS. 6 and 37. The front portion 92 is slidably received in the guide groove of the guide member 102 and the rear portion 93 is slidably received in the guide groove of the guide member 104.

The opposite base plate 11 is likewise provided with a pair of parallel slots 105 and 106 which are aligned with the slots 101 and 103 on the base plate 7 and through which the front and rear portions 92 and 93, respectively, of the propelling member 90 slidably extend (FIGS. 6 and 38). At its vertical edge remote from the rear end wall 125 of the casing 78, the base plate 11 is formed with a rectangular opening 108 lying on the horizontal centerline of the base plate as shown in FIG. 38. The opening 108 provides a clearance which allows for the axial movement of a switch button 107 mounted on the front end wall 113 of the casing 78. At the bottom of the opening 108, there is provided a stop member 109 adapted for limiting the inward movement of the switch button 107. The switch button 107 includes a coaxial inward extension and the stop member 109 has an aperture 110 in which the inward extension of the switch button 107 is slidably received. A similar opening 112 is recessed from the opposite vertical edge of the base plate 11 to mount axially movably a pushbutton 111 adapted to actuate the two driving rings 69 and 69' for the unlocking purpose simultaneously.

Attention is now directed to a method of assembling the door lock of this invention.

A spring 46 is inserted into the bottom of each of the lateral bores 47 and 48 of each of the five tumbler rings 28. Likewise, a spring 46 is placed into the bottom of each of the lateral bores 47' and 48' of each of the other five tumbler rings 28'. An engage pin 30 is then placed into each of the lateral bores 47, 48, 47' and 48' with its inner end contacting the spring 46. Each engage pin 30 is inserted into the lateral bore to the extent that its third recess 57 is aligned with the aperture 50 or 51 of the tumbler ring 28 or the aperture 50' or 51' of the tumbler ring 28'. A stop pin 49 is inserted into the third recess 57 through the aperture 50, 51, 50' or 51' to hold the engage pin 30 in such a position relative to the tumbler ring 28 or 28' that it is concealed in the associated lateral bore along the greater part of its length, while a minor lengthwise portion of each engage pin 30 is exposed beyond the outer extremity of the lateral extension 31 or 31' of each tumbler ring, as illustrated in FIG. 68.

The washer 24 is inserted over one end of the lock shaft 1 (i.e., the end disposed on the right-hand side of FIG. 6) in such a manner that its spacer projections 29 are directed inwardly, i.e., toward the center of the casing 78. Then, the first driving ring 69 for the unlocking purpose, the washer 20 and the second driving ring 69' for the unlocking purpose are inserted over the end of the lock shaft 1 in that order. This insertion is done in such a manner that the guiding recesses 25 and 21 of the washers 24 and 20, respectively, and the engaging recesses 70 and 70' of the driving rings 69 and 69', respectively, are all aligned with the guide opening 12 of the base plate 11, and also that the driving rods 72 and 72' extend along the lock shaft 1 toward the other end of the latter. The lock shaft 1 is then secured to the base plate 11 by engagement of the projection 2' into the aperture 13 of the base plate 11 and insertion of a screw or the like into the tapped hole 3' through the aperture 14 as illustrated in FIG. 38. Then, the five tumbler rings 28' and the five other tumbler rings 28 are inserted over the other end of the lock shaft 1 in such a manner that their spacer projections 52' and 52 are directed toward the other end of the lock shaft 1, namely, in the same direction as the spacer projections 29 on the washer 24 face, and that their engaging recesses 32' and 32 are all aligned with the guide opening 12 of the base plate 11.

The washer 16, the second driving ring 58' for the locking purpose, the washer 20 and the first driving ring 58 for the locking purpose are then inserted over the lock shaft 1 as illustrated in FIG. 6. This insertion is done in such a fasion that the guiding recesses 17 and 21 of the washers 16 and 20, respectively, and the engaging recesses 59' and 59 of the driving rings 58' and 58 for the locking purpose, respectively, are all aligned with the guide opening 12 of the base plate 11, and also that the driving rods 61' and 61 extend along the lock shaft 1 toward the driving rings 69 and 69' for the unlocking purpose carried on the remote end of the lock shaft 1. The lock shaft 1 is connected to the base plate 7 on that side of the latter from which the guide members 102 and 104 project as shown in FIG. 6. This connection is done by engagement of the projection 2 into the aperture 9 of the base plate 7 and insertion of a screw or the like into the tapped hole 3 of the lock shaft 1 through the aperture 10 of the base plate 7, as illustrated in FIG. 37.

The lock bolt 4 is inserted into the hole 98 on the side portion 97 of the propelling member 90 at its inner end as shown on the right-hand side of FIG. 6. The apertures 99 on the propelling member 90 are aligned with the tapped holes 91 on the lock bolt 4 as can be seen from FIG. 38 and a screw or the like is inserted into each tapped hole 91 through the corresponding aperture 99 to secure the lock bolt 4 to the propelling member 90. The lock bolt 4 extends throught the guide opening 12 of the base plate 11, along the guide groove 5 of the lock shaft 1 and through the guide opening 8 of the base plate 7. The front portion 92 of the propelling member 90 extends throught the slot 105 of the base plate 11, the guide member 102 and the slot 101 of the base plate 7. Likewise, the rear portion 93 extends through the slot 106 of the base plate 11, the guide member 104 and the slot 103 of the base plate 7. The lock bolt projects from the casing 78 to the extent that the magnet 100 on the propelling member 90 contacts the iron piece 15 on the base plate 11 as illustrated in FIG. 6.

Figure 1:
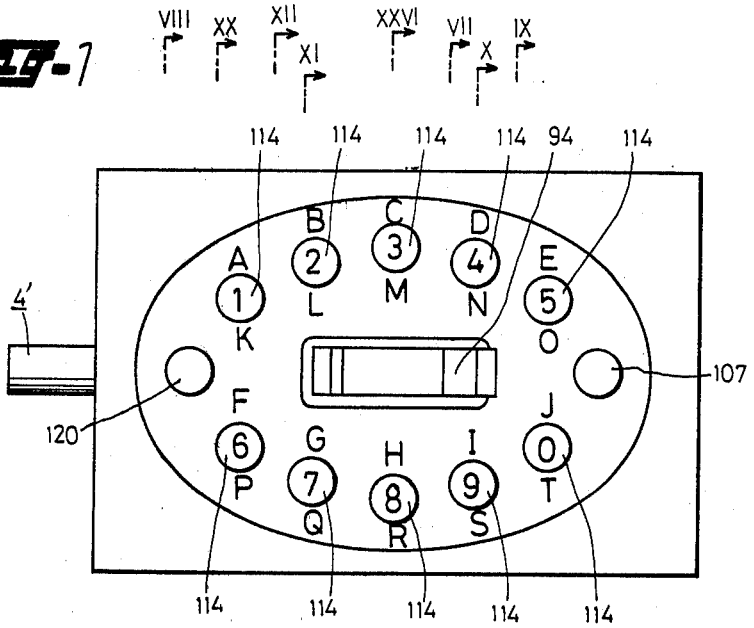
FIG. 1 is a front elevational view of the door lock embodying this invention.

The lever 94 is mounted on the front face 113 of the casing 78 approximately in the center therof, as shown in FIGS. 1 and 6, with its teeth 95 engaged in the tooth receiving apertures 96 of the front portion 92 of the propelling member 90 and its handle extension projecting from the casing 78.

Figure 10:
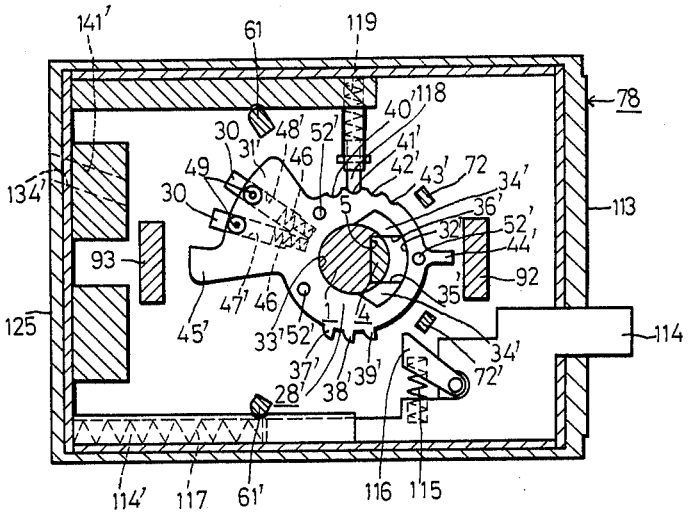
FIG. 10 is a vertical sectional view taken along the line X—X of FIG. 1.
Figure 12:
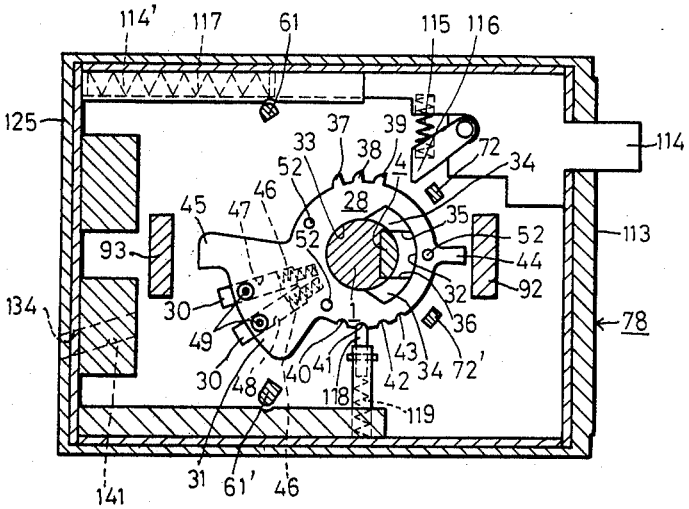
FIG. 12 is a vertical sectional view taken along the line XII—XII of FIG. 1.

The door lock of this invention further includes ten pushbuttons 114 each adapted to actuate one of the ten tumbler rings 28 and 28'. As shown in FIGS. 10 and 12, each pushbutton 114 comprises a head portion projecting outwardly from the front face 113 of the casing 78 and a body portion connected to the head portion and slidably supported within the casing 78. A pawl member 116 is rotatably carried on the body portion and loaded by a spring 115. The pawl member 116 on each pushbutton 114 is engageable with the ratchet tooth 37, 38 or 39 or 37', 38' or 39' of one of the tumbler rings 28 and 28' when the pushbutton 114 is depressed. A return spring 117 is associated with each pushbutton 114 to permit rotation of one of the tumbler rings 28 and 28' by a predetermined angle each time the pushbutton 114 is depressed. Due to the symmetrically opposite construction of the five tumbler rings numbered 28 relative to the other five tumbler rings 28' as already described, all the pushbuttons 114 are of the identical construction, but have their head portions projecting from the front face 113 of the casing 78 in a generally ellipitcal pattern as shown in FIG. 1. For the sake of convenience, the ten pushbuttons 114 are digitially indentifiable as shown in FIG. 1. The user of this door lock may select some of these nemerals to formulate a desired number which he may wish to remember and use as a code for operation of the door lock. Further, or alternatively, the exterior surface of the front face 113 of the casing 78 may advantageously carry a series of alphabetical letters adjacent to the respective pushbuttons 114 as shown in FIG. 1. The user may choose a number of alphabetical letters to formulate a word which he may consider easy to remember for use as a code for door lock operation.

Figure 7:
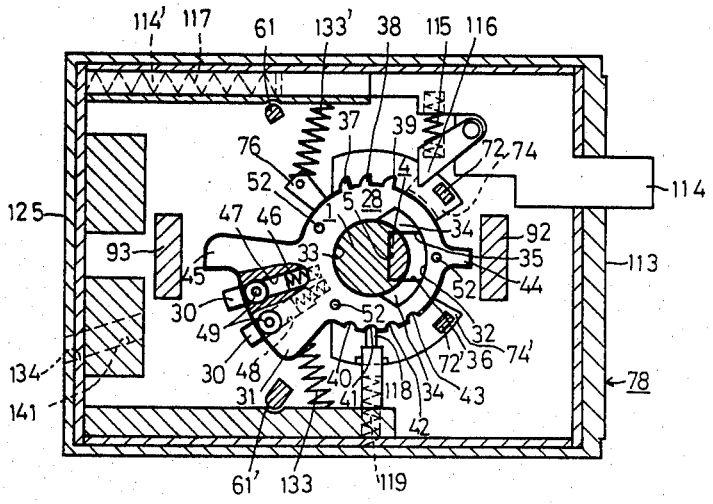
FIG. 7 is a vertical sectional view taken along the line VII—VII of FIG. 1.

The door lock of this invention further includes ten positioning pins 118 each engaged with one of the tumbler rings 28 and 28' as shown in FIG. 3 to hold each tumbler ring in position. Each positioning pin 118 is supported on a spring 119 in the casing 78 and has a free end extending beyond the spring 119 and engaged in one of the peripheral recesses 40 through 43 or 40' through 43' of one of the tumbler rings 28 and 28' to hold the tumbler ring in position as shown, for example, in FIG. 7.

Figure 8:
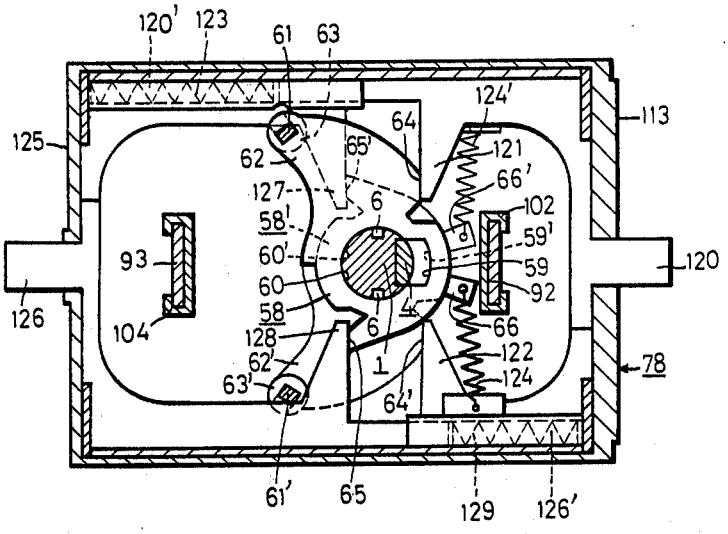
FIG. 8 is a vertical sectional view taken along the line VIII—VIII of FIG. 1.

Numeral 120 indicates a pushbutton adapted to actuate the two driving rings 58 and 58' for the locking purpose simultaneously. The pushbutton 120 includes a head portion extending outwardly from the front face 113 of the casing 78 as shown in FIG. 8. The pushbutton 120 further includes an inwardly extending body portion which is substantially of the inverted C-shaped construction as viewed in FIG. 8. The body of the pushbutton 120 is formed by an upwardly and a downwardly extending portion in the casing 78. A finger 121 projects from the upwardly extending portion and engages the abutment edge 64 on the first driving ring 58. A similar finger 122 projects from the downwardly extending portion of the pushbutton 120 and engages the abutment edge 64' on the second driving ring 58' for the locking purpose. Each of the upwardly and downwardly extending portions of the pushbutton 120 has a free end portion slidably extending along the interior surface of the casing 78 and supported on a return spring 123. A spring 124 is fastened at one end to the lug 66 on the first driving ring 58 and has another end fastened to a member on the interior surface of the casing 78. A like spring 124' is connected between the lug 66' on the second driving ring 58' and a member on the opposite interior surface of the casing 78 as shown in FIG. 8. The springs 124 and 124' serve to maintain the abutment edges 64 and 64' in contact with the fingers 121 and 122 respectively. Each time the pushbutton 120 is depressed, the finger 121 is inwardly displaced to rotate the first driving ring 58, with the driving rod 61 carried thereon, by an angular distance equal to three times as large as a predetermined angle against the action of the spring 124. Simultaneously, the finger 122 is inwardly displaced to rotate the second driving ring 58', with the driving rod 61' carried thereon, by the same angular distance against the action of the spring 124'. Consequently, upon rotation of any one of the tumbler rings 28, the driving rod 61' engages either the finger 45 on the tumbler ring 28 or the engage pin 30 projecting from the lateral bore 47 or 48 of the tumbler ring 28. Likewise, upon rotation of any one of the tumbler rings 28', the driving rod 61 engages either the finger 45' on the tumbler ring 28' or the engage pin 30 projecting from the lateral bore 47' or 48' of the tumbler ring 28'. Thus, the tumbler rings 28 and 28' are rotated simultaneously into their normal locked position.

The lever 94' is mounted on the rear face 125 of the casing 78 approximately in the center thereof with its teeth 95' engaged in the tooth receiving apertures 96' of the rear portion 93 of the propelling member 90 and its handle extension projecting from the casing 78.

Numeral 126 indicates another pushbutton adapted to drive the two driving rings 58 and 58' for the locking purpose simultaneously. The pushbutton 126 indicates a head portion extending outwardly from the rear face 125 of the casing 78 as shown in FIG. 8. The pushbutton 126 is generally similar in construction to the pushbutton 120 on the front side of the casing 78. The pushbutton includes an inwardly extending body portion which has a substantially C-shaped configuration as viewed in FIG. 8. The body of the pushbutton 126 is formed by an upwardly and a downwardly extending portion disposed opposite to the pushbutton 120 in the casing 78. A finger 127 projects from the upwardly extending portion and engages the abutment edge 65' on the second driving ring 58'. A similar finger 128 projects from the downwardly extending portion and engages the abutment edge 65 on the first driving ring 58. Each of the upwardly and downwardly extending portions of the pushbutton 126 has a free end portion slidably extending along the interior surface of the casing 78 and supported on a return spring 129. The abutment edge 65' is normally maintained in contact with the finger 127 by the spring 124', while the abutment edge 65 is normally maintained in contact with the finger 128 by the spring 124. Each time the pushbutton 126 is depressed, the finger 127 is inwardly displaced to rotate the second driving ring 58', with the driving rod 61' carried thereon, by an angular distance equal to three times as large as a predetermined angle against the action of the spring 124'. Simultaneously, the finger 128 is inwardly displaced to rotate the first driving ring 58, with the driving rod 61 carried thereon, by the same angular distance against the action of the spring 124. Consequently, upon rotation of any one of the tumbler rings 28, the driving rod 61' engages either the finger 45 on the tumbler ring 28 or the engage pin 30 projecting from the lateral bore 47 or 48 of the tumbler ring 28. Likewise, upon rotation of any one of the tumbler rings 28', the driving rod 61 engages either the finger 45' on the tumbler ring 28' or the engage pin 30 projecting from the lateral bore 47' or 48' of the tumbler ring 28'. Thus, the tumbler rings 28 and 28' are rotated simultaneously into their normal locked position.

Figure 9:
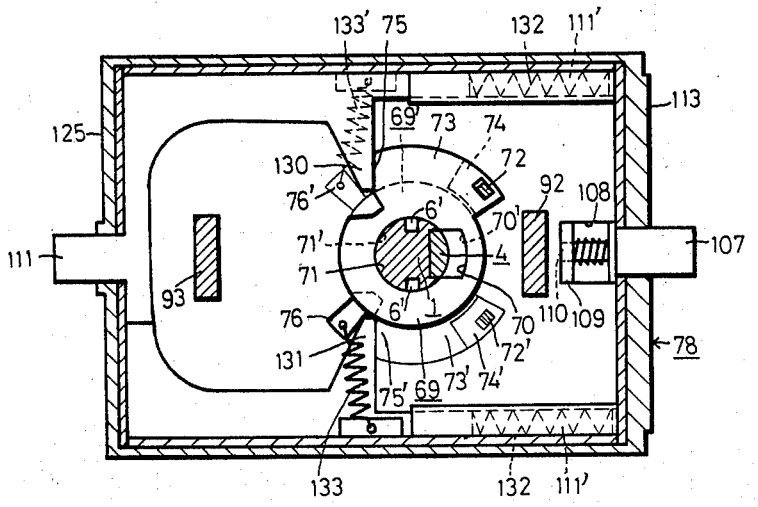
FIG. 9 is a vertical sectional view taken along the line IX—IX of FIG. 1.

The door lock of this invention further includes a pushbutton 111 adapted to actuate the two driving rings 69 and 69′ for the unlocking purpose simultaneously. As shown in FIG. 9, the pushbutton 111 includes a head portion projecting outwardly from the rear face 125 of the casing 78, and an inwardly extending body portion formed by an upwardly and a downwardly extending portion in the casing 78. A finger 130 projects from the upwardly extending portion and engages the abutment edge 75 on the first driving ring 69. A similar finger 131 projects from the downwardly extending portion and engages the abutment edge 75′ on the second driving ring 69′. Each of the upwardly and downwardly extending portions has a free end portion slidably extending along the interior surface of the casing 78 and supported on a return spring 132. A spring 133 is fastened at one end to the lug 76 on the first driving ring 69 and has another end fastened to a member in the casing 78. A similar spring 133′ is connected between the lug 76′ on the second driving ring 69′ and the casing 78. The springs 133 and 133′ normally maintain the abutment edges 75 and 75′ in contact with the fingers 130 and 131, respectively. Each time the pushbutton 111 is depressed, the finger 130 is inwardly displaced to rotate the first driving ring 69, with the driving rod 72 carried thereon, by an angular distance equal to twice as large as a predetermined angle against the action of the spring 133. Simultaneously, the finger 131 is inwardly displaced to rotate the second driving ring 69′, with the driving rod 72′ carried thereon, by the same angular distance against the action of the spring 133′. Consequently, upon rotation of any one of the tumbler rings 28 and 28′, the driving rods 72 and 72′ engage the fingers 44 and 44′ on the tumbler rings 28 and 28′, respectively, so that the tumbler rings 28 and 28′ are rotated simultaneously into the position in which their engaging recesses 32 and 32′ are aligned with the guide opening 12 of the base plate 11.

Figure 2:
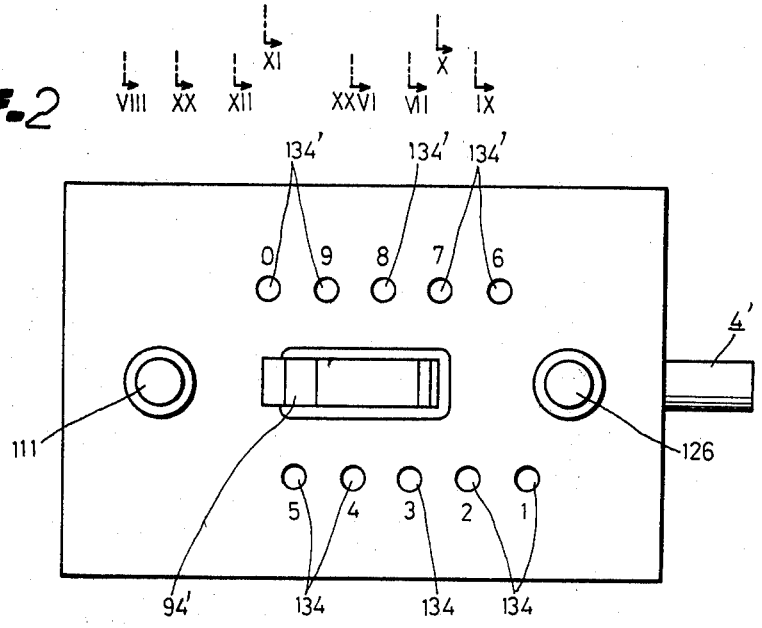
FIG. 2 is a rear elevational view of the door lock.

The rear face 125 is provided therethrough with a series of five guide apertures 134 as shown in FIG. 2. Each aperture 134 has a longitudinal axis extending at an angle to the rear face 125 and lying on an extension of the lateral bore 47 of one tumbler ring 28 as shown in FIG. 12 when the tumbler ring 28 stays in its position in which its engaging recess 32 is aligned with the guide opening 12 of the base plate 11. The five apertures 134 each operationally related to one tumber ring 28 are positioned on the lower half of the rear face 125 of the casing 78, while the five pushbuttons 114 each adapted to operate one tumbler ring 28 are located on the upper half of the front face 113. The rear face 125 is also provided therethrough on the upper half thereof with another series of five guide apertures 134′ as shown in FIG. 2, while the remaining five pushbuttons 114 each adapted to operate one of the tumbler rings 28′ are located on the lower half of the front face 113. Each aperture 134′ has a longitudinal axis extending at an angle to the rear face 125 and lying on an extension of the lateral bore 47′ of one tumbler ring 28′ as shown in FIG. 10 when the tumbler ring 28′ stays in its position in which its engaging recess 32′ is aligned with the guide opening 12 of the base plate 11. The five apertures 134′ are each operationally related to one of the tumbler rings 28′ as will hereinafter be described in further detail. The exterior surface of the rear face 125 may conveniently carry adjacent to the apertures 134 and 134′ the same numerals as are carried by the corresponding pushbuttons 114 on the front face 113, as shown in FIGS. 1 and 2. Further, the rear face 125 may advantageously carry the corresponding alphabetical letters as has been described and shown with respect to the front face 113.

The casing 78 has a pair of vertically spaced, horizontally elongate blocks attached to the interior surface of the rear face 125 as shown in, for example, FIG. 12. The lower block is provided therethrough with a series of five bores 141 extending at an angle to the rear face 125 and each connected with one of the apertures 134 coaxially therewith as shown in FIG. 12. Likewise, the upper block has five similar bores 141′ each connected with one of the apertures 134′ coaxially therewith as shown in FIG. 10.

Figure 14:
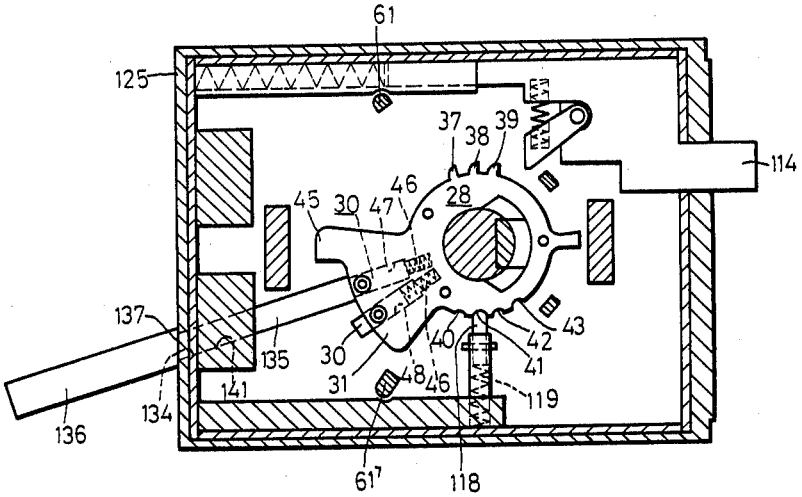

Referring to FIG. 14, numeral 135 indicates a first cylindrical guide rod having a handle extension 136 connected to one end thereof. The handle extension 136 is greater in diameter than the guide rod 135 and that end of the hendle extension 136 at which it is connected to the guide rod 135 has an inclined face 137 adapted to closely fit the exterior surface of the rear face 125 when the guide rod 135 is totally inserted into the casing 78 as shown in FIG. 14. The guide rod 135 is adapted for insertion through one pair of the apertures 134 or 134′ and the bores 141 or 141′ to guide protrusion of one engage pin 30 out of the lateral bore 47 or 48 or 47′ or 48′ of the corresponding tumbler ring 28 or 28′. The guide rod 135 has a length which is sufficient to permit its free end to reach the outer edge of the tumbler ring extension 31 or 31′ when the guide rod 135 is totally inserted in the casing 78 with the inclined face 137 of the handle extension 136 contacting the rear face 125 as shown in FIG. 14.

Figure 35:
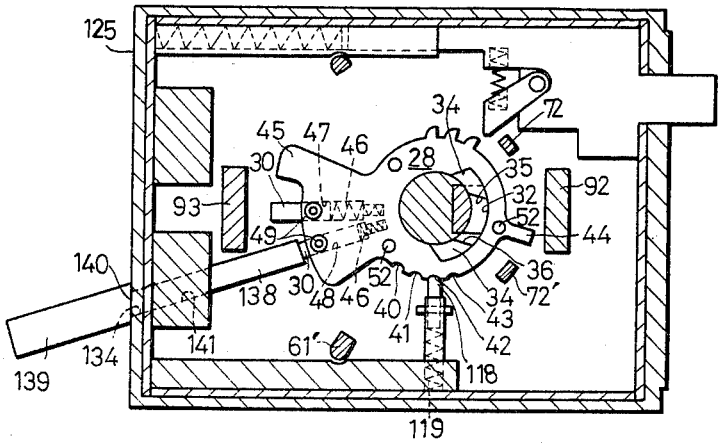
FIG. 35 is a view similar to FIG. 26, but illustrating the various parts in a different operational position.
Figure 36:
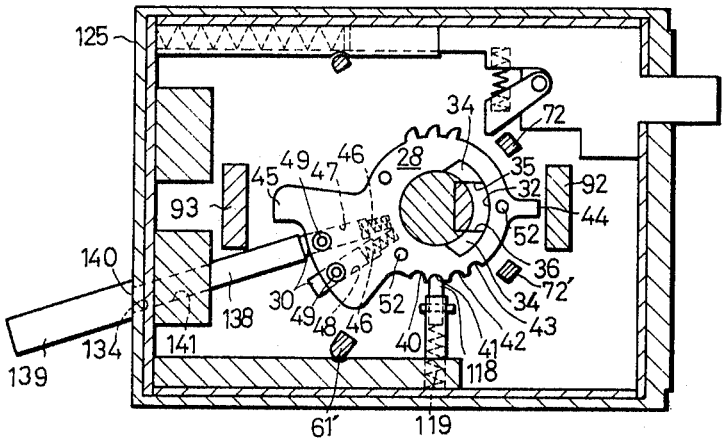
FIG. 36 is a view similar to FIG. 20, but illustrating the various parts in a different operational position.

A second cylindrical guide rod 138, which is similar to the first guide rod 135 in construction, has a handle extension 139 connected to one end thereof and having one end face 140 inclined to closely fit the exterior surface of the rear face 125 as shown in FIGS. 35 and 36. The guide rod 138 is adapted to extend through any one of the apertures 134 and 134′ and the corresponding bore 141 or 141′ and abut on one engage pin 30 to guide insertion of the engage pin 30 into one of the lateral bores of the corresponding tumbler ring 28 or 28′. The handle extension 139 is greater in diameter than the guide rod 138. As is obvious from comparison of FIGS. 14 and 36, the second guide rod 138 is somewhat smaller in length than the first guide rod 135 and fails to reach the outer edge of the tumber ring extension even when it is totally inserted in the casing 78.

A piece of iron 143 is attached to the interior surface of one side wall 142 of the casing 78 and faces the magnet 100 on the side portion 97 of the propelling member 90.

Figure 30:
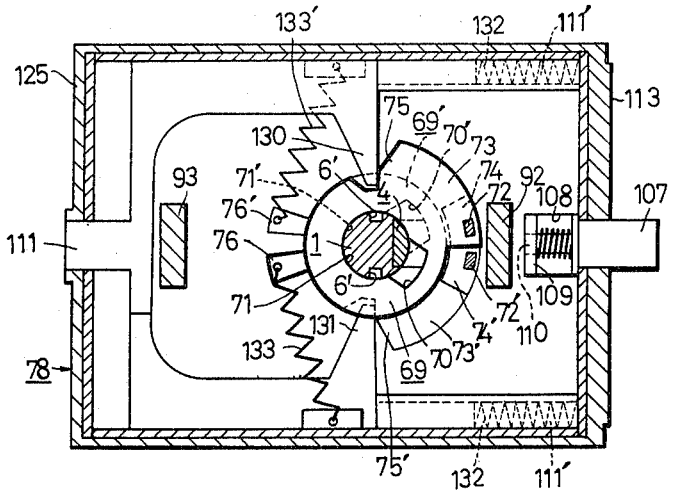
FIGS. 30 to 34 are views similar to FIG. 9, but illustrating the various parts in different operational positions.
Figure 31:
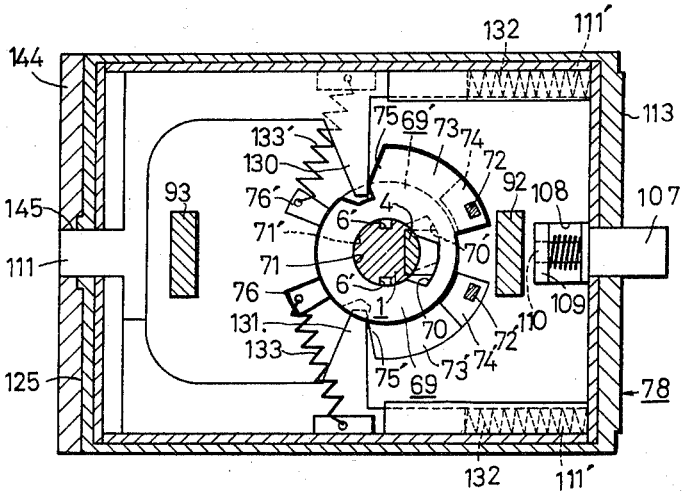

The door lock of this invention further includes a pushbutton adaptor 144 adapted for use with the pushbutton 111 to change the code number formulated by selecting a desired number of numerals assigned to the pushbuttons 114 for the unlocking purpose. The pushbutton adaptor 144 is shown in FIG. 31. The pushbutton adaptor 144 is provided in its center therethrough with an opening 145 through which the pushbutton 111 can extend. The adaptor 144 comprises a generally flat plate having a thickness which is equal to about a half of the length of that portion of the pushbutton 111 which projects outwardly from the rear face 125 when the pushbutton 111 is in its fully outwardly retracted position. It will, thus, be observed that when the adaptor 144 is inserted over the pushbutton 111 and the pushbutton 111 is depressed, the depth of its depression can be reduced to about a half as is obvious from comparision of FIGS. 30 and 31, whereby the angle of rotation of the driving rings 69 and 69' may be reduced to a half.

The switch button 107 may be used as a button for swiching on and off a buzzer or bell, as desired.

Numerals 111', 114', 120' and 126' indicate support members on the interior surface of the casing 78 having bores in which the free end portions of the pushbuttons 111, 114, 120 and 126, respectively, are slidably received.

In the door lock of this invention as assembled as herein above described, all of the tumbler rings 28 and 28' stay in their positions shown in FIGS. 12 and 10, respectively, in which their engaging recesses 32 and 32' are aligned with the guide opening 12 of the base plate 11. The lock bolt 4 extends along the guide groove 5 of the lock shaft 1 and stays in its disengaged position. The engage pin 30 for each of the lateral bores 47, 48, 47' and 48' of the tumbler rings is held in the corresponding lateral bore along the major part of its length as shown in FIGS. 12 and 10. Thus, all of the tumbler rings 28 and 28' are in their inoperative position.

Figure 11:
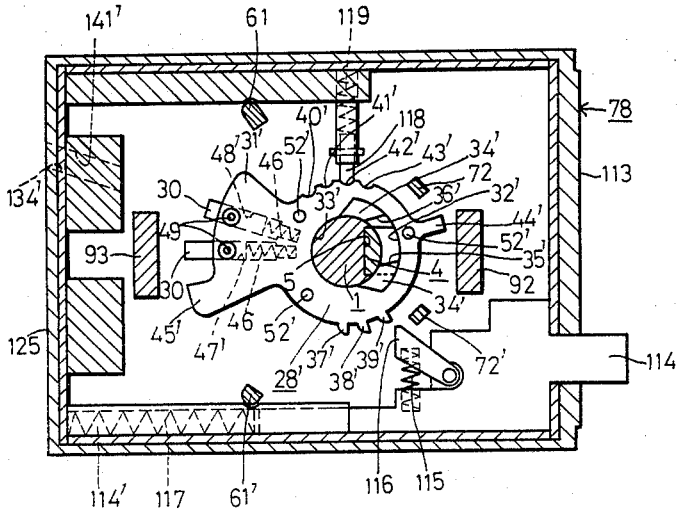
FIG. 11 is a vertical sectional view taken along the line XI—XI of FIG. 1.
Figure 20:
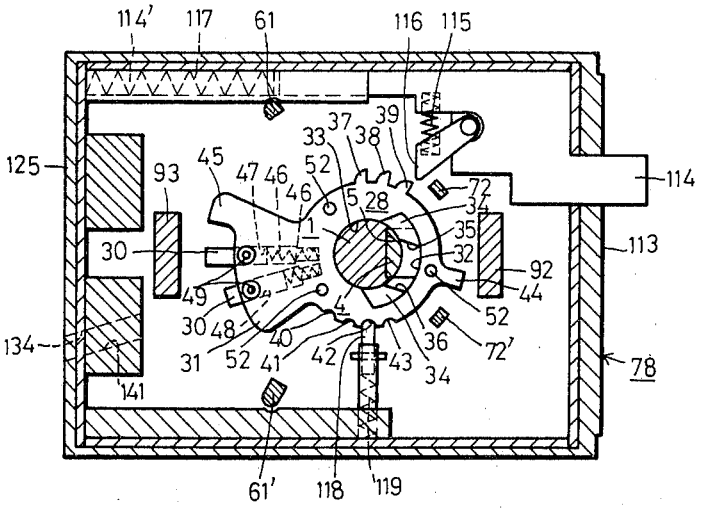
FIG. 20 is a vertical sectional view taken along the line XX—XX of FIG. 1.

In order to bring the door lock into its locked position, it is necessary to rotate one or more of the tumbler rings 28 and 28' into their position shown in FIGS. 20 and 11, respectively, in which the upper tongue 35 on the or each tumbler ring 28 or the lower tongue 35' on the or each tumber ring 28' is engaged in one of the notches 79 through 88 on the lock bolt 4 to thereby hold the lock bolt 4 axially immovably.

The invention will now be described by way of several examples of use in which a code number is arbitrarily chosen for the locking and unlocking operation.

Let the door lock be set so that it can be opened only when the pushbuttons 114 carrying the numerals "1" and "7" are both depressed once and the pushbutton 114 to which the numeral "4" is assigned is depressed twice. In this position of the door lock, the remaining seven pushbuttons 114 stay in thier inoperative position. They may be called make-believe pushbuttons and do not in any way take part in the operation of the door lock. For the purpose of simplicity, the three pushbuttons 114 to which the numerals "1", "7" and "4", respectively, are allocated may hereinafter be called the "1" pushbutton 114, "7" pushbutton 114 and "4" pushbutton 114, respectively; the tumbler rings 28 and 28' which are operationally associated with the "1", "7" and "4" pushbuttons 114 will be called the "1" tumbler ring 28, "7" tumbler ring 28' and "4" tumbler ring 28; and the rear face apertures 134 and 134' operationally associated with the "1", "7" and "4" tumbler rings will be called the "1" aperture 134, "7" aperture 134' and "4" aperture 134, respectively.

Figure 15:
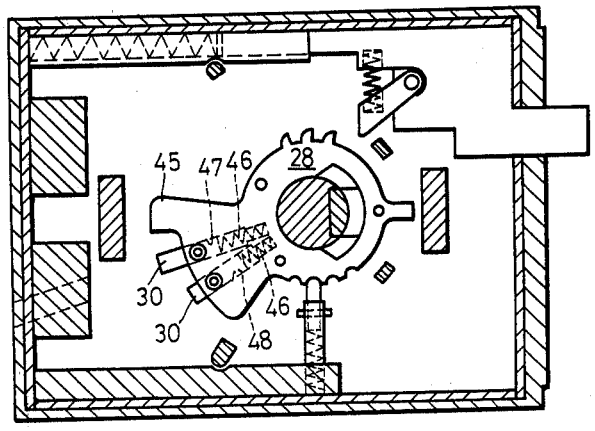

On the indoor side of a door on which the door lock of this invention may usually be mounted, the guide rod 135 is inserted through each of the "1" aperture 134, "4" aperture 134 and "7" aperture 134' until the inclined end face 137 of its handle extension 136 contacts the exterior surface of the rear face 125. The inner end of the guide rod 135 abuts on each corresponding engage pin 30 and effects further insertion of the engage pin 30 into the lateral bore 47 of the corresponding "1" or "4" tumbler ring 28. While the stop pin 49 is itself stationary and the engage pin 30 is movable, the stop pin 49 is herein described as moving relative to the engage pin 30 or any relevant portion thereof for the purpose of facilitating the explanation. The stop pin 49 leaves the third recess 57 on each engage pin 30 and moves along the first guide groove 55, as the engage pin 30 is pushed inwardly and totally enclosed in the lateral bore 47, when the stop pin 49 is received in the second recess 54 on the engage pin 30, all in the manner already described. Upon removal of the external force from the engage pin 30 by withdrawal of the guide rod 135, the engage pin 30 is retracted outwardly by the action of the spring 46, whereupon the stop pin 49 leaves the second recess 54, moves along the second guide groove 56 and enters the first recess 53 as shown in FIG. 66. The engage pin 30 is thus positioned as shown in FIG. 15 and functionally takes the place of the finger 45. Likewise, the positional adjustment of the engage pin 30 in the lateral bore 47' of the "7" tumbler ring 28' is effected in a similer manner and the engage pin 30 projects to the extent that it can functionally take the place of the finger 45'.

Figure 17:
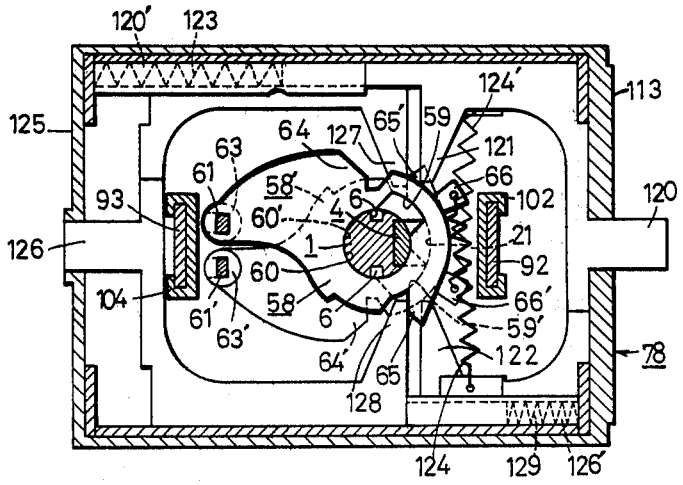
Figure 19:
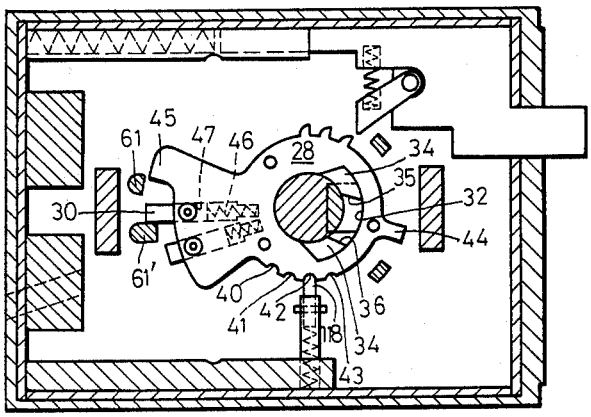

Then, the pushbutton 126 is depressed to move the first and second driving rings 58 and 58' for the locking purpose simultaneously from the position shown in FIG. 8 to the position of FIG. 17. This is effected, as hereinbefore described, by the inward displacement of the fingers 128 and 127 on the pushbutton 126 which causes rotation of the first and second driving rings 58 and 58' about the lock shaft 1 by exerting force on the abutment edges 65 and 65' against the action of the springs 124 and 124'. Consequently, the first and second driving rods 61 and 61' are moved into their respective positions shown in FIG. 17. Thus, as shown in FIGS. 15 and 19, the driving rod 61' engages the engage pins 30 projecting from the lateral bores 47 of the "1" and "4" tumbler rings 28, respectively, and the driving rod 61 engages the engage pin 30 projecting from the lateral bore 47' of the "7" tumbler ring 28', whereby the "1", "4" and "7" tumbler rings 28 and 28'' are rotated by a predetermined angle. Then, the depressions of the pushbutton 126 is discontinued and the pushbutton 126 returns to its original position under the action of the springs 129, while at the same time, the driving rings 58 and 58', along with the driving rods 61 and 61', return to their respective original positions under the action of the springs 124 and 124'. The "1" tumber ring 28, "4" tumbler ring 28 and "7" tumbler ring 28'', however, are maintained in their rotated position as shown in FIG. 20 by virtue of the positioning pins 118 engaging in the peripheral recesses 42 and 42' of the respective tumbler rings 28 and 28'. This is the position which is appropriate to the "1" and "7" tumbler rings 28 and 28'', but is not yet suitable for the "4" tumbler ring 28 because the door lock is going to be set to be opened by double depression of the "4" pushbutton 114 while each of the "1" and "7" pushbuttons 114 is depressed once. It is, therefore, necessary to further adjust the position of the "4" tumbler ring 28 so that the door lock can be opened only when the "4" pushbutton 114 is twice depressed.

Figure 23:
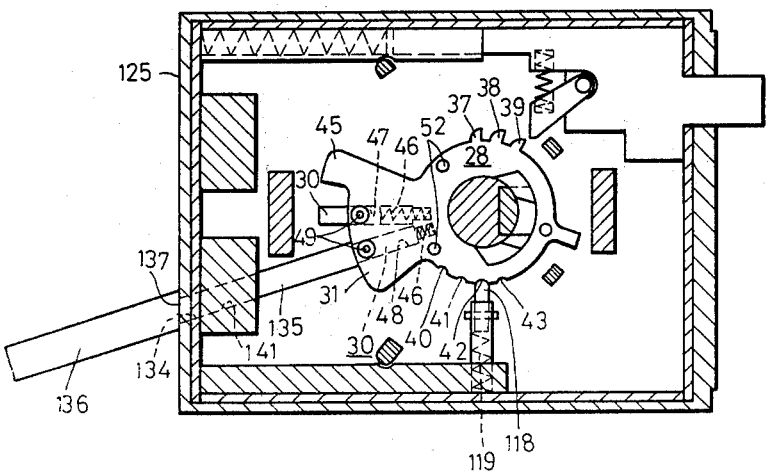
Figure 24:
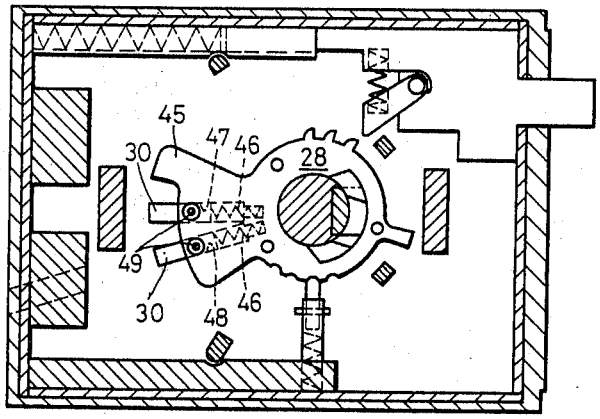
Figure 25:
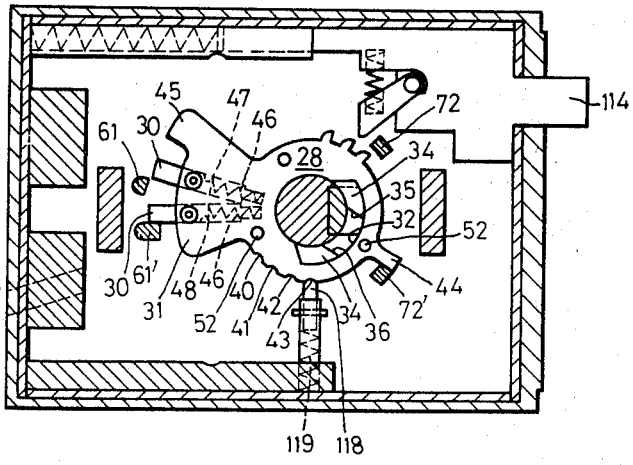
FIG. 25 is a view similar to FIG. 24, but illustrating the various parts in a different operational position.
Figure 26:
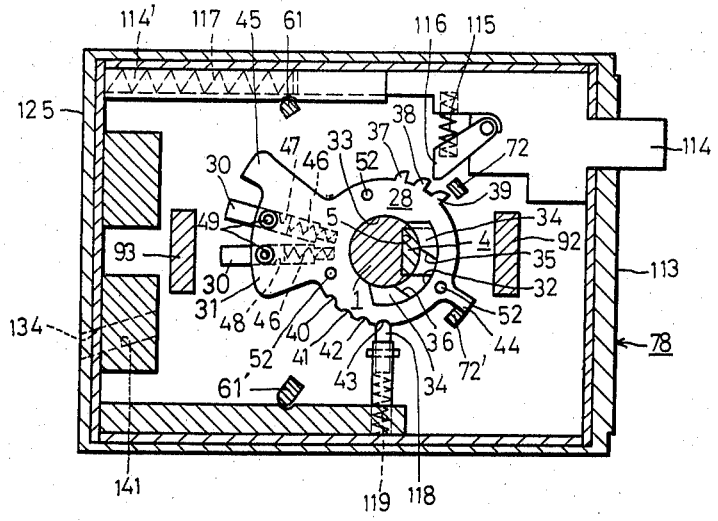
FIG. 26 is a vertical sectional view taken along the line XXVI—XXVI of FIG. 1.

In its position shown in FIG. 20, the "4" tumbler ring 28 has its second lateral bore 48 axially aligned with the "4" aperture 134 of the rear face 125. In this position of the "4" tumbler ring 28, the guide rod 135 is inserted through the "4" aperture 134 until the inclined end face 137 of its handle extension 136 contacts the exterior surface of the rear face 125 as shown in FIG. 23, whereby the engage pin 30 is totally concealed in the lateral bore 48 of the "4" tumbler ring 28 with the stop pin 49 received in the second recess 54 on the engage pin 30. Upon withdrawal of the guide rod 135 at this moment, the engage pin 30 is retracted outwardly as the stop pin 49 moves into the first recess 53, so that the engage pin 30 projects to the extent that it functionally takes the place of the finger 45 on the tumbler ring 28 as shown in FIG. 24. The pushbutton 126 is depressed again to rotate the driving rings 58 and 58', along with the driving rods 61 and 61', in a manner similar to that which has already been described. The driving rod 61' engages the engage pin 30 projecting from the lateral bore 48 of the "4" tumbler ring 28 and the "4" tumbler ring 28 is rotated by a predetermined angle as shown in FIG. 25. The pushbutton 126 is released and the driving rings 58 and 58', along with the driving rods, return to their original positions under the action of the spring 124 and 124'. The "4" tumbler ring 28, however, remains in its rotated position with the positioning pin 118 engaged in the peripheral recess 43 of the "4" tumbler ring 28 as shown in FIG. 26.

The door lock is now in its operative position in which the "1" and "7" tumbler rings 28 and 28' have each been rotated by a predetermined angle, while the "4" tumbler ring 28 has been rotated twice by a predetermined angle each time. The tongues 35, 35' and 35 of the three tumbler rings are engaged in the notches 79, 82 and 85, respectively, of the lock bolt 4, whereby the lock bolt 4 is fixed or held longitudinally immovable. The remaining seven tumbler rings 28 and 28' stay in their respective original, inoperative positions. Thus, the "1" and "7" pushbuttons 114 operationally related to the "1" and "7" tumbler rings 28 and 28', respectively, are each set for single depression and the "4" pushbutton 114 operationally associated with the "4" tumbler ring 28 is set for double depression to cooperate with the "1" and "7" pushbuttons 114 to open the door lock.

Figure 27:
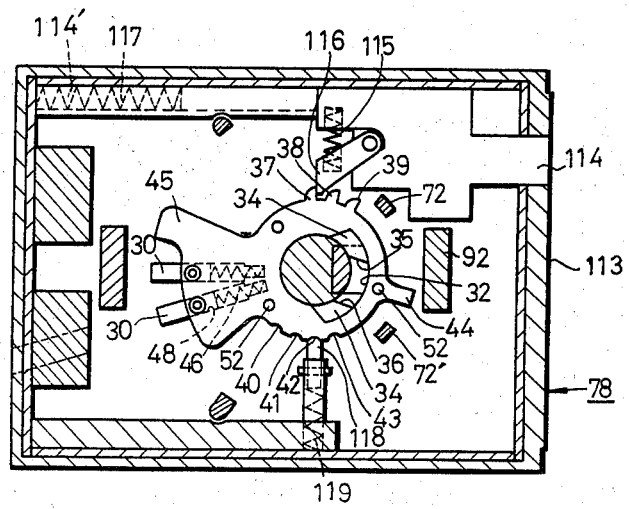
FIGS. 27 to 29 are views similar to FIG. 26, but illustrating the various parts in different operational positions.
Figure 28:
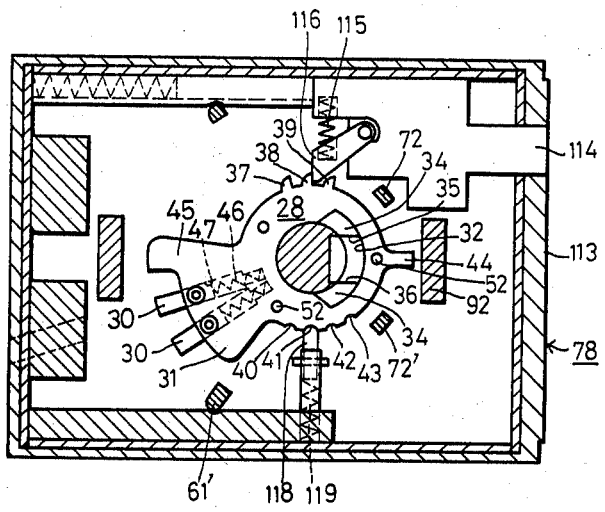
Figure 29:
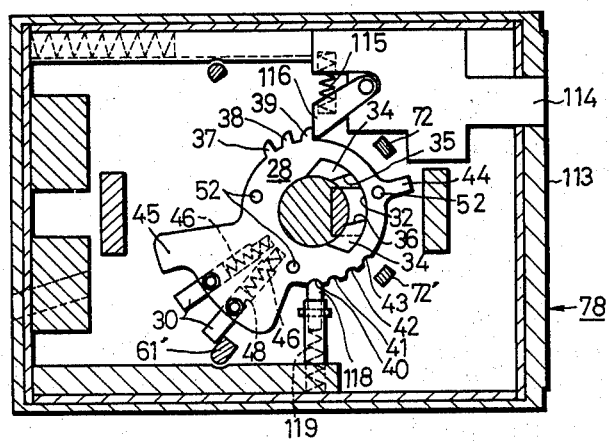

In order to open the door lock on the outdoor side of a door or the like in which the front face 113 is usually positioned, the selected pushbuttons 114 may be depressed a predetermined number of times. When the "1" and "7" pushbuttons 114 are each depressed once against the action of the spring 117, the pawl member 116 on the "1" pushbutton 114 engages the ratchet tooth 38 on the "1" tumbler ring 28 and rotates the "1" tumbler ring 28 by a predetermined angle; likewise, the pawl member 116 on the "7" pushbutton 114 engages the ratchet tooth 38' on the "7" tumbler ring 28' and rotates the "7" tumbler ring 28' by the same predetermined angle. Thus, the "1" tumbler ring 28 and the "7" tumbler ring 28' are moved from their position shown in FIG. 20 to the position of FIG. 21. When the "4" pushbutton 114 is depressed twice against the action of the spring 117, the pawl member 116 on the "4" pushbutton 114 engages first the ratchet tooth 37 on the "4" tumbler ring 28 as shown in FIG. 27 and then the ratchet tooth 38 as shown in FIG. 28, whereby the "4" tumbler ring 28 is rotated twice by a predetermined angle each time. Thus, the "4" tumbler ring 28 is progressively moved from its position shown in FIG. 26, through the position of FIG. 27, to the position of FIG. 28. Thus, the engaging recesses 32, 32' and 32 of the "1", "7" and "4" tumbler rings are aligned with the guide opening 12 of the base plate 11 and their tongues 35, 35' and 35 are disengaged from the notches 79, 82 and 85, respectively, of the lock bolt 4. The "1", "7" and "4" tumbler rings are maintained in their respective rotated positions already described with the three corresponding positioning pins 118 engaged in the peripheral recesses 41, 41' and 41, respectively, of the three tumbler rings. Then, the lever 94 is rotated counterclockwise as viewed in FIG. 6. The teeth 95 on the lever 94 are progressively engaged with the tooth receiving apertures 96 of the front portion 92 of the propelling member 90, whereby the propelling member 90 is retracted to thereby retract the lock bolt 4 inwardly until the magnet 100 on the side portion 97 of the propelling member 90 contacts the iron piece 143 on the interior surface of the side wall 142 of the casing 78, whereupon the lock bolt 4 is totally concealed in the casing 78. The door lock is, thus, opened or released from its locked position.

Figure 13:
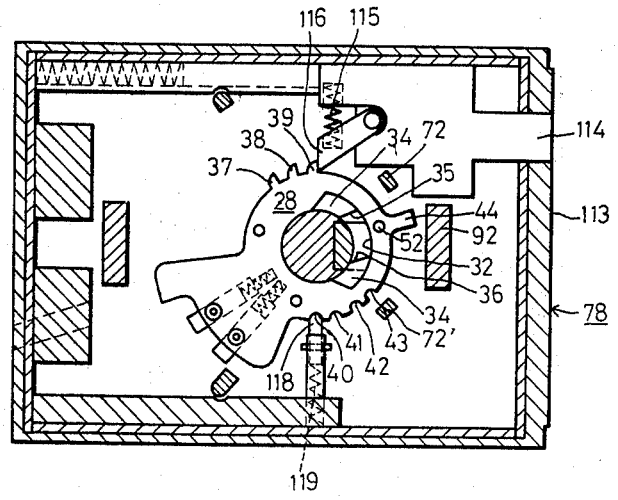
FIGS. 13 to 15 are views similar to FIG. 12, but illustrating the various parts in different operational positions.
Figure 18:
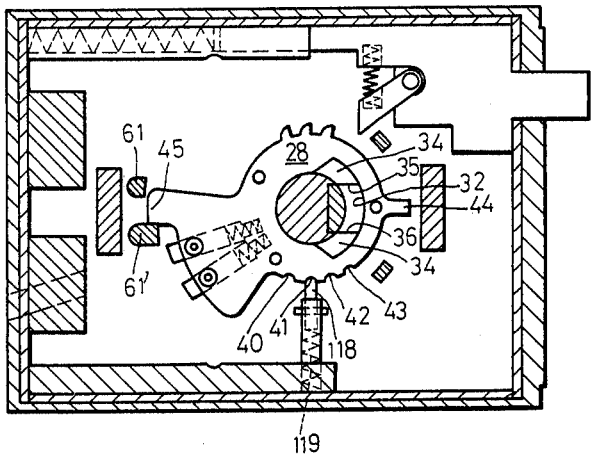
Figure 21:
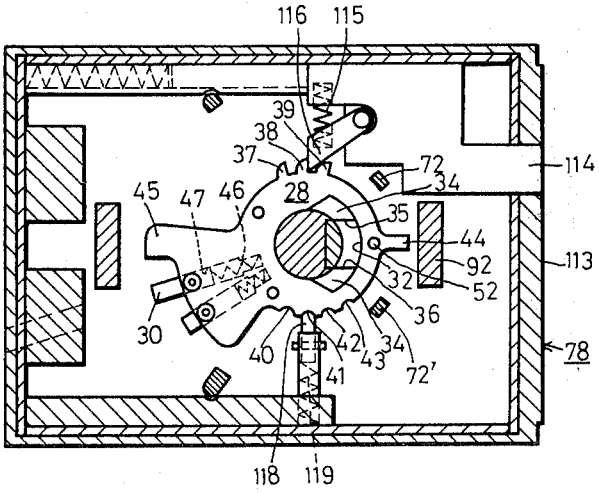
FIGS. 21 to 24 are views similar to FIG. 20, but illustrating the various parts in different operational positions.
Figure 22:
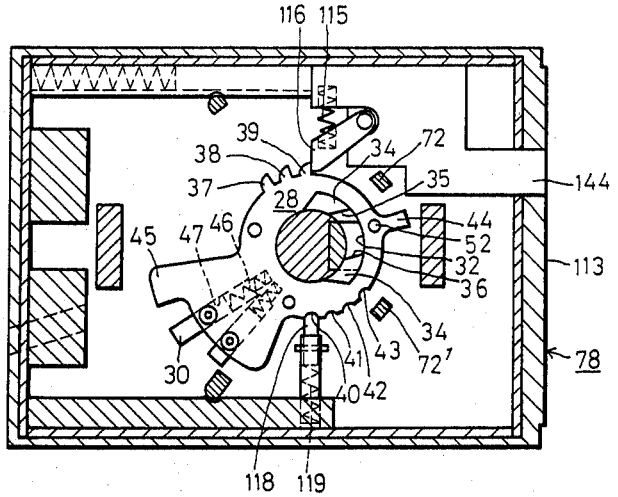

If by mistake, any other pushbutton 114 not selected to formulate the code number, for example, the "3" pushbutton 114 is depressed against the action of the spring 117, the corresponding "3" tumbelr ring 28 is rotated by a predetermined angle by engagement of the pawl member 116 with the ratchet tooth 39 as shown in FIGS. 12 and 13 and the tongue 36 on the "3" tumbler ring 28 is engaged in the notch 83 of the lock bolt 4, whereby the lock bolt 4 is more rigidly fixed in place. The same thing will happen if any of the selected pushbuttons 114 is depressed more or less often than necessary. If, for example, the "1" pushbutton 114 set for single depression is erroneously depressed twice, the corresponding "1" tumbler ring 28 is further rotated by a predetermined angle by engagement of the pawl member 116 with the ratchet tooth 39 as shown in FIGS. 20, 21 and 22 and the tongue 36 on the "1" tumbler ring 28 is engaged in the notch 79 of the lock bolt 4, whereby the lock bolt 4 is more rigidly fixed in place. Likewise, if the "4" pushbutton 114 set for double depression is depressed only once, the tongue 35 on the corresponding "4" tumbler ring 28 remains engaged in the notch 85 of the lock bolt 4 as shown in FIGS. 26 and 27; therefore, the door lock cannot be opened. If the "4" pushbutton 114 is depressed three times, the pawls member 116 on the "4" pushbutton 114 will engage the ratchet tooth 39 on the "4" tumbler ring 28 and rotate the "4" tumbler ring 28 further by a predetermined angle, whereby the tongue 36 on the "4" tumbler ring 28 will engage in the notch 85 of the lock bolt 4 to thereby fix the lock bolt 4 in place more rigidly. In order now to restore the door lock into its correctly operable position, it is first necessary to depress the pushbutton 120 and move it from its position shown in FIG. 8 to the position of FIG. 16, so that the fingers 121 and 122 of the pushbutton 120 engaging the abutment edges 64 and 64' on the first and second driving rings 58 and 58', respectively, cause the driving rings 58 and 58' to rotate together by an angular distance equal to three times as large as the predetermined angle against the action of the springs 124 and 124'. consequently, the driving rod 61' engages the finger 45 on the "3" tumbler ring 28 as shown in FIG. 18, the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25, whereby the "3", "1" and "4" tumbler rings 28 are rotated back into their respective original positions. the pushbutton 120 is then released and returns to its original position under the action of the springs 123, whereby the driving rings 58 and 58', along with the driving rods 61 and 61', return to their original positions under the action of the springs 124 and 124'. The "3", "1" and "4" tumbler rings 28 will, however, remain in their respective rotated positions with the positioning pins 118 engaged in their respective peripheral recesses 41, 42 and 43 as shown in FIGS. 18, 19 and 25, respectively. The door lock can now be opened if its pushbutton operation is correctly effected as hereinbefore described.

Figure 16:
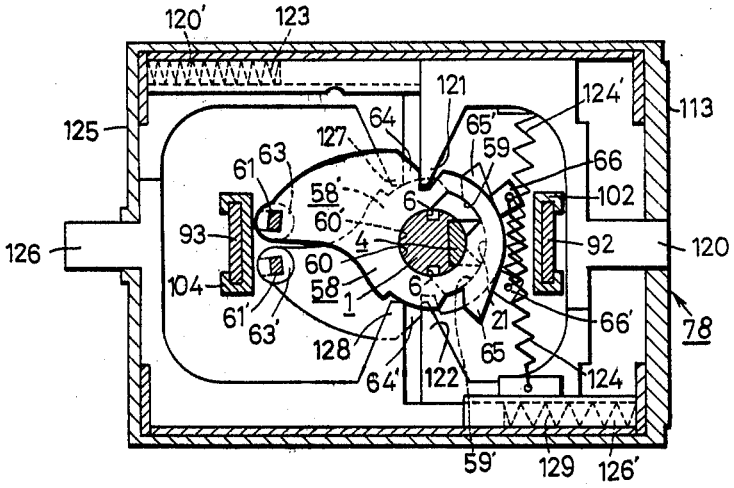
FIGS. 16 to 19 are views similar to FIG. 8, but illustrating the various parts in different operational positions.

When a man standing in front of the front face of the door lock wishes to close the door lock, he rotates the lever 94 clockwise as viewed in FIG. 6 to allow its teeth 95 to be progressively engaged in the tooth receiving apertures 96 on the front portion 92 of the propelling member 90. Thus, the propelling member 90, along with the lock bolt 4 carried thereon, is advanced until the magnet 100 on the side portion 97 contacts the iron piece 15 on the base plate 11 with the lock bolt 4 projecting outwardly from the casing 78 as shown in FIG. 6. Then, the pushbutton 120 is depressed, and its fingers 121 and 122 engaging the abutment edges 64 and 64' of the driving rings 58 and 58', respectively, urge the driving rings 58 and 58', along with the driving rods 61 and 61' carried thereon, to rotate about the lock shaft 1 together by an angular distance equal to three times as large as the predetermined angle against the action of the springs 124 and 124' as shown in FIGS. 6, 8 and 16. The driving rod 61' engages the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25. Likewise, the driving rod 61 engages the engage pin 30 projecting from the lateral bores 47' of the "7" tumbler ring 28'. Thus, the "1" tumbler ring 28 and the "7" tumbler ring 28'are both rotated by the predetermined angle and the "4" tumbler ring 28 is rotated by an angular distance equal to twice as large as the predetermined angle. The pushbutton 120 is, then, released and returns to its original position under the action of the springs 123 and the driving rings 58 and 58', along with the driving rods 61 and 61', return to their respective original positions under the action of the springs 124 and 124'. The "1" tumbler ring 28, "4" tumbler ring 28 and "7" tumbler ring 28' will, however, remain in their respective rotated positions with the positioning pins 118 engaged in their respective peripheral recesses 42, 43 and 42'. The tongues 35, 35 and 35' of the "1", "4" and "7" tumbler rings, respectively, become thus engaged in the corresponding notches 79, 85 and 82 of the lock bolt 4, whereby the lock bolt 4 is held in its outwardly projecting position. In this position of the lock bolt 4, its extension 4' is received in a bolt receiving hole formed on a door frame, whereby the door is locked.

Figure 32:
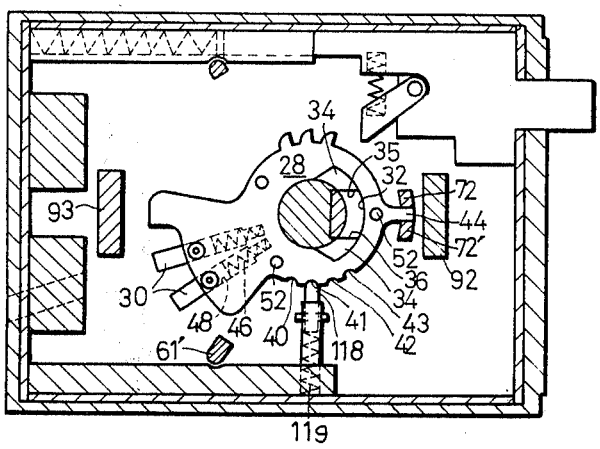
Figure 33:
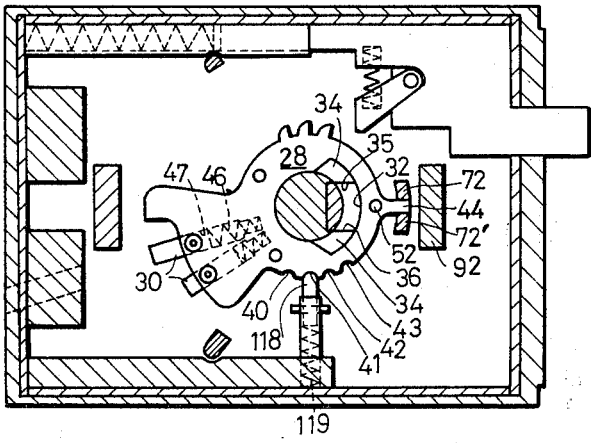

Attention is now directed to the mode of operation on the indoor side of the door on which the door lock of this invention is mounted. In order to open the door lock, the pushbutton 111 on the rear face 125 is depressed and moved from its position shown in FIG. 9 to the position of FIG. 30. The finger 130 of the pushbutton 111 engaging the abutment edge 75 of the first driving ring 69 for the unlocking purpose urges the driving ring 69 to rotate along with the driving rod 72 against the action of the spring 133. Likewise, the other finger 131 of the pushbutton 111 engaging the abutment edge 75' of the second driving ring 69' urges the driving ring 69' to rotate along with the driving rod 72' against the action of the spring 133'. Thus, the driving rings 69 and 69' are simultaneously rotated by an angular distance equal to twice as large as the predetermined angle. Consequently, the driving rod 72' engages the finger 44 on the "1" tumbler ring 28 as shown in FIGS. 20 and 33 and the finger 44 on the "4" tumbler ring 28 as shown in FIGS. 26 and 32, while the driving rod 72 engages the finger 44' on the "7" tumbler ring 28', whereby the "1", "4" and "7" tumbler rings are all rotated until their respective fingers 44, 44 and 44' are brought into alignment in a horizontal plane extending through the longitudinal axis of the lock shaft 1 and their respective engaging recesses 32, 32 and 32' are all aligned with the guide opening 12 of the base plate 11. Then, the pushbutton 111 is released from pressure and allowed to return to its original position shown in FIG. 9 under the action of the springs 132, and the driving rings 69 and 69', along with the driving rods 72 and 72' carried thereon, return to their original positions under the action of the springs 133 and 133'. The "1" tumbler ring 28, "4" tumbler ring 28 and "7" tumbler ring 28' will, however, remain in their rotated positions with the positioning pins 118 engaged in their respective peripheral recesses 41, 41 and 41' and with their respective engaging recesses 32, 32 and 32' all remaining aligned with the guide opening 12 of the base plate, while their tongues 35, 35 and 35' are disengaged from the notches 79, 85 and 82, respectively, of the lock bolt 4. Then, the lever 94' is rotated clockwise as viewed in FIG. 6 to engage its teeth 95' progressively with the tooth receiving apertures 96' on the rear portion 93 of the propelling member 90, whereby the propelling member 90 is retracted toward the side wall 142 of the casing 78 until the magnet 100 on its side portion 97 contacts the iron piece 143 on the side wall 142. Consequently, the lock bolt 4 is retracted and its locking extension 4' is totally retracted into the casing 78, whereupon the door lock is released from its locking position relative to the door.

In order to place the door lock in its locked position by manipulation on the indoor side of the door, the lever 94' is rotated counterclockwise as viewed in FIG. 6 to advance the propelling member 90 or move it away from the side wall 142 until the magnet 100 contacts the iron piece 15 on the base plate 11 as shown in FIG. 6, whereby the locking extension 4' on the lock bolt 4 projects outwardly from the casing 78 into the bolt receiving hole in the door frame not shown. Then, the pushbutton 126 is depressed and moved from its position shown in FIG. 8 to the position of FIG. 17. All in a manner similar to that which has already been described, the fingers 127 and 128 of the pushbutton 126 engaging the abutment edges 65' and 65 of the driving rings 58' and 58, respectively, urge the driving rings 58' and 58 to rotate about the lock shaft 1 along with the driving rods 61' and 61 against the action of the springs 124' and 124 as shown in FIGS. 8 and 17. The driving rod 61' engages the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25. Likewise, the driving rod 61 engages the engage pin 30 projecting from the lateral bore 47' of the "7" tumbler ring 28'. Thus, the "1" tumbler ring 28 and the "7" tumbler ring 28' are both rotated by the predetermined angle and the "4" tumbler ring 28 is rotated by an angular distance equal to twice as large as the predetermined angle. Then, the pushbutton 126 is released from pressure and allowed to return to its original position shown in FIG. 8 under the action of the springs 129, and the locking rings 58 and 58', along with the driving rods 61 and 61', return to their original positions under the action of the springs 124 and 124'. The "1", "4" and "7" tumbler rings will, however, remain in their respective ortated positions with the positioning pins 118 engaged in their respective peripheral recesses 42, 43 and 42', whereby the tongues 35, 35 and 35' on the "1", "4" and "7" tumbler rings engage in the notches 79, 85 and 82, respectively, of the lock bolt 4 to thereby hold the lock bolt 4 in its outwardly projecting position and lock the door to the door frame.

Figure 34:
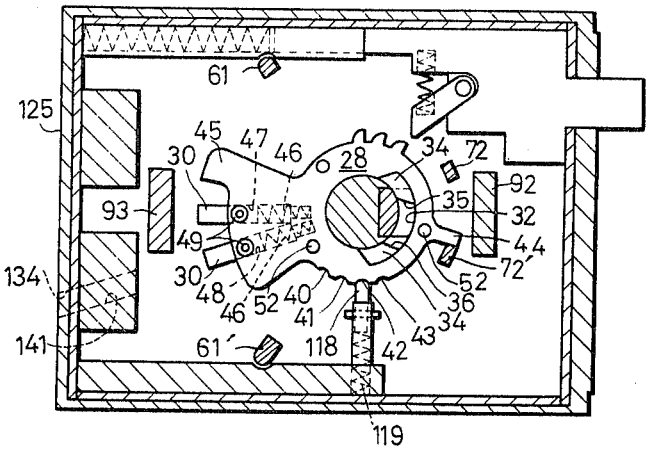

When it is desired to change the code number inputted into the door lock of this invention, it is first necessary to cancel the old code number. With the door lock maintained in its closed position, the adaptor 144 is inserted over the pushbutton 111 and the pushbutton 111 is depressed as shown in FIG. 31. The fingers 130 and 131 of the pushbutton 111 engaging the abutment edges 75 and 75' of the driving rings 69 and 69' urge the driving rings 69 and 69' to rotate, along with the respective driving rods 72 and 72', against the action of the springs 133 and 133'. But the driving rings 69 and 69' can now rotate only an angular distance equal to the predetermined angle, rather than twice as large as that as previously described, because the depth of depression of the pushbutton 111 is restricted to a half by the adaptor 144. As the result, the driving rod 72' engaging the finger 44 of the "4" tumbler ring 28 for double operation causes the "4" tumbler ring 28 to rotate only by an angular distance equal to the predetermined angle as shown in FIGS. 26 and 34. The pushbutton 111 is released from depression to return to its initial position under the action of the springs 132, whereby the driving rings 69 and 69' also return to their initial positions under the action of the springs 133 and 133', together with the driving rods 72 and 72'. Although the driving rod 72' thus moves away from engagement with the finger 44 of the "4" tumbler ring 28, the "4" tumbler ring 28 will remain in its rotated position with the positioning pin 118 engaged in its peripheral recess 42, so that the engage pin 30 projecting from the lateral bore 48 of the "4" tumbler ring 28 is axially aligned with the "4" aperture 134 in the rear face 125, as shown in FIG. 34. The second guide rod 138 is then inserted through the aperture 134 until the inclined end face 140 of its handle extension 139 contacts the exterior surface of the rear face 125 as shown in FIG. 35. The guide rod 138 abuts on the outer end of the engage pin 30 and pushes it into the lateral bore 48 of the tumbler ring 28 against the action of the spring 46 as the stationary stop pin 49 moves relative to the engage pin 30 away from the first recess 53 and along the first groove 55. Since the second guide rod 138 is smaller in length than the first guide rod 135 as stated before, however, the relative movement of the stop pin 49 to the engage pin 30 is such that the stop pin 49 fails to reach the second recess 54 on the engage pin 30, but stops in front of the third recess 57 as shown in FIG. 67. The guide rod 138 is then pulled out of the casing, whereby the engage pin 30, which has been released from application of force by the guide rod 138, is moved outwardly under the action of the spring 46 and the stop pin 49 slides into the third recess 57. In other words, the engage pin 30 is moved from its position shown in FIG. 66 to its position shown in FIG. 68, in which the engage pin 30 is concealed in the lateral bore 48 along the greater part of its length and the position of the "4" tumbler ring 28 is now equal to that of the "1" tumbler ring 28 shown in FIG. 20 for single pushbutton operation.

Then, the adaptor 144 is removed and the pushbutton 111 is depressed again. Its fingers 130 and 131 engaging the abutment edges 75 and 75' of the driving rings 69 and 69' cause the driving rings 69 and 69' to rotate, along with the respective driving rods 72 and 72', simultaneously as shown in FIGS. 9 and 30. The driving rod 72' on the second driving ring 69' engages the fingers 44 on the "1" and "4" tumbler rings 28, respectively, while the driving rod 72 on the first driving ring 69 engages the finger 44' on the "7" tumbler ring 28', whereby the fingers 44 and 44' on the three tumbler rings are rotated into horizontal alignment with one another in a horizontal plane extending centrally across the door lock as is obvious from FIG. 33. Depression of the pushbutton 111 is then discontinued. While this allows the driving rings 69 and 69' to return to their initial positions along with the driving rods 72 and 72', the "1" tumbler ring 28, the "4" tumbler ring 28 and the "7" tumbler ring 28' will remain in their rotated position as the positioning pins 118 hold them by their engagement with the peripheral recesses 41 and 41' of the respective tumbler rings. The lateral bores 47 and 47' of the "1", "4" and "7" tumbler rings are now axially aligned with the "1" aperture 134, "4" aperture 134 and "7" aperture 134', respectively, of the rear face 125. Then, the second guide rod 138 is inserted through each of the "1", "4" and "7" apertures 134 and 134' until the inclined end face 140 of its handle extension 139 contacts the exterior surface of the rear face 125 as shown in FIG. 36. In each case of guide rod insetion, the guide rod 138 abuts on the outer end of the engage pin 30 and pushes it into the lateral bore 47 against the action of the spring 46 with the movement of the stop pin 49 relative to the engage pin 30. The stop pin 49 leaves the first recess 53 on the engage pin 30 and slides along the first groove 55 to permit rotation of the engage pin 30 about its own axis during its inward movement relative to the lateral bore 47. As the second guide rod 138 is smaller in length than the first guide rod 135, however, it can push the engage pin 30 inwardly only to the extent that the stop pin 49 stops in front of the third recess 57 without traveling through the entire length of the first groove 55 and reaching the second recess 54, as shown in FIG. 67, Therefore, upon removal of the guide rod 138, the engage in 30 moves outwardly to some extent until the stop pin 49 slips into the third recess 57 under the action of the spring 46. The engage pin 30 is now concealed in the lateral bore 47 along the greater part of its length as best shown in FIG. 68 and all of the "1", "4" and "7" tumbler rings 28 and 28' that have been adapted for operation by a single depression of the corresponding pushbuttons are brought back to their respective inoperative positions as shown in FIGS. 12 and 10. The engaging recess 32 or 32' of each of these three tumbler rings is aligned with the guide opening 12 in the base plate 11, whereby the lock bolt 4 is released from any interference by any tumbler ring and freely movable along the guide groove 5 on the lock shaft 1. The old code number is thus canceled and the door lock is now ready for inputting any new code number as desired in accordance with the sequence which has hereinbefore been described by way of example.

According to this invention, there is thus provided a pushbutton operated door lock which is very easy to handle either on the indoor or outdoor side of a door for its sure opening and closing operation. The function of the pushbuttons provided for rotated the tumbler rings individually can be changed freely and easily. A desired number of pushbuttons may be selected for the unlocking operation, while the remaining pushbuttons are left in their inoperative positions in which they do not in any way take part in the unlocking operation. Any of the pushbutton may be selected for depression more than once for the unlocking operation. For example, one or more pushbuttons may be used twice, so that the door lock can be opened only when those particular pushbuttons are depressed twice. All of these pushbuttons are identical in appearance and produce an identical sound or finger touch, whichever of the pushbuttons may be depressed and how many times they may be depressed. Therefore, it is impossible for any third person to know which pushbuttons should be depressed to open the door lock, or whether they should be depressed once or twice. Thus, the door lock of this invention works excellently for crime prevention.

A most significant feature of this invention resides in the free changeability of the number selected for the unlocking operation. This is quite easily possible whenever and as often as desired, by changing the angular position of any tumbler rings involved as appropriate and the position of the associated engage pins relative to the lateral bores of the tumbler rings by manipulation through the apertures in the casing wall. For this purpose, the door lock of this invention further includes a number of guide rods adapted for selective insertion through the apertures in the casing wall to abut on the adjacent engage pins and effect the in and out movement thereof relative to the lateral bores of the tumbler rings.

The door lock of this invention does advantageously not require for its operation a key of any sort which has hitherto been a source of trouble with a conventional door lock, since a key is easily lost or misplaced and necessitates utmost care in its safe custody.

What I claim is:

1. A pushbutton operated door lock comprising:

a casing having front and rear faces;

a lock shaft in said casing;

a lock bolt slidably carried by said lock shaft and having a multiplicity of notches juxtaposed along the length of said lock bolt;

a multiplicity of tumbler rings rotatably supported on said lock shaft and juxtaposed along the length thereof, each of said tumbler rings having an outer peripheral edge formed with a plurality of lateral bores;

a plurality of engage pins each received in one of said lateral bores of each of said tumbler rings and movable in and out relative to said one lateral bore for restricting an angle of rotation of said each tumbler ring;

a multiplicity of first pushbuttons on said front face of said casing adapted for individual engagement with said tumbler rings to rotate said tumbler rings individually;

a second pushbutton on said front face of said casing adapted for simultaneous engagement with all of said tumbler rings to rotate said tumbler rings simultaneously;

a pair of third pushbuttons on said rear face of said casing adapted for simultaneous engagement with all of said tumbler rings to rotate said tumbler rings simultaneously;

said first pushbuttons being associated with said second and third pushbuttons to permit a number of said tumbler rings to selectively engage with and disengage from said notches upon rotation of said tumbler rings;

a first guide rod and a second guide rod for guiding said engage pins for said in and out movement thereof; and said rear face of said casing being formed therethrough with a multiplicity of guiding apertures for insertion of said guide rods, whereby the angle of rotation of said tumbler rings may be controlled for selectively changing the function of said first pushbuttons.

2. A pushbutton operated door lock as defined in claim 1, wherein each of said engage pins has a cylindrical peripheral surface formed with a first recess in the mid-portion of said engage pin somewhat closer to one end of said engage pin and a second recess spaced from said first recess toward the other end at an angular distance defined by approximately two-thirds of one rotation around said cylindrical peripheral surface, an oblique groove being formed each between said first recess and second recess and between said second recess and first recess for guiding a stop pin, a third recess being provided between said first and second recesses and in the vicinity of said second recess, said third recess being located on the opposite side of said oblique groove from said second recess, a spring being confined in each of said lateral bores and one of said engage pins being slidably received in said each lateral bore with said one end of said engage pin resting against said spring, said stop pin being stationary and perpendicular to said lateral bore and being engageable with said first or third recess, said engage pin being rotatable about its own axis as it is guided by said stop pin for said in and out movement upon application of force to said other end of said engage pin and interruption of said force application.

3. A pushbutton operated door lock as defined in claim 2, wherein said door lock further includes said first guide rod for insertion through any of said guiding apertures for abutment on the corresponding engage pin to permit said engage pin to compress said spring and rotate on said stop pin to be concealed within the corresponding lateral bore upon arrival of said second recess at said stop pin, withdrawal of said first guide rod causing said engage pin to be urged outwardly by said spring and rotate on said stop pin until arrival of said first recess at said stop pin, whereupon about a half of length of said engage pin projects beyond said lateral bore, while the remaining half is left concealed therein; and wherein said door lock further includes said second guide rod which is somewhat smaller in length than said first guide rod, said second guide rod being adapted for insertion through any of said guiding apertures for abutment on the corresponding engage pin to permit said engage pin to compress said spring and rotate on said stop pin until said stop pin is positioned in said oblique groove between said second and third recesses, withdrawal of said second guide rod causing said engage pin to be urged outwardly by said spring and rotate in a reverse direction until said stop pin is received in said third recess to position said engage pin so that it is concealed in said lateral bore along the greater part of its length, whereby said in and out movement of said engage pin can be freely controlled from the outside of said casing.

4. A pushbutton operated door lock as defined in claim 3, wherein said door lock includes driving rods rigidly connected to driving rings for the locking purpose and driving rings for the unlocking purpose, said driving rings being rotatable by said second and third pushbuttons, said driving rods being engageable with said tumbler rings to rotate all of said tumbler rings simultaneously.

5. A pushbutton operated door lock as defined in claim 4, wherein each of said tumbler rings is formed along its peripheral edge with a plurality of juxtaposed recesses; and wherein said door lock includes a plurality of positioning pins resiliently supported in said casing and each engageable with any of said recesses of said tumbler ring to hold said tumbler ring in a desired rotated position.

6. A pushbutton operated door lock as defined in claim 5, wherein said front face of said casing carries different alphabetical letters placed respectively adjacent to said first pushbuttons.

* * * * *

UNITED STATES PATENT AND TRADEMARK OFFICE

CERTIFICATE OF CORRECTION

PATENT NO. : 4,350,031

DATED : September 21, 1980

INVENTOR(S) : Junichi Shimono

It is certified that error appears in the above-identified patent and that said Letters Patent is hereby corrected as shown below:

Column 3, line 5, "exploded" should read -- enlarged --.

Column 5, line 15, after "28" insert -- as illustrated in Fig. 66 --.

Column 10, line 35, "The", first occurrence, should read -- As shown in Figure 6 the --.

Column 11, line 44, "A" should read -- Referring now to Figs. 66-69 of the drawing, --.

Column 20, line 11, "tumbelr" should read -- tumbler --.

Signed and Sealed this

*Fifteenth* Day of *March 1983*

[SEAL]

*Attest:*

GERALD J. MOSSINGHOFF

*Attesting Officer*

*Commissioner of Patents and Trademarks*